US007500630B2

(12) United States Patent
Rogers

(10) Patent No.: US 7,500,630 B2
(45) Date of Patent: Mar. 10, 2009

(54) REVERSIBLE BLADE FOR A COMMINUTION MACHINE

(75) Inventor: Terry Rogers, Oconto, WI (US)

(73) Assignee: Badger Shredding Products, Inc., Sturgeon Bay, WI (US)

( * ) Notice: Subject to any disclaimer, the term of this patent is extended or adjusted under 35 U.S.C. 154(b) by 177 days.

(21) Appl. No.: 11/556,880

(22) Filed: Nov. 6, 2006

(65) Prior Publication Data

US 2007/0057101 A1 Mar. 15, 2007

Related U.S. Application Data

(63) Continuation-in-part of application No. 10/415,516, filed as application No. PCT/US01/48282 on Oct. 30, 2001, now Pat. No. 7,131,606.

(60) Provisional application No. 60/244,828, filed on Oct. 30, 2000.

(51) Int. Cl.
*B02C 18/16* (2006.01)

(52) U.S. Cl. ..... 241/295; 241/236; 241/300

(58) Field of Classification Search ..... 241/189.2, 241/235, 236, 242, 243, 294, 295, 300
See application file for complete search history.

(56) References Cited

U.S. PATENT DOCUMENTS

| | | | | |
|---|---|---|---|---|
| 2,869,793 | A | 1/1959 | Montgomery | |
| 3,474,973 | A | 10/1969 | Gundlach | |
| 3,642,214 | A | 2/1972 | Blackwell, Jr. | |
| 4,241,882 | A | 12/1980 | Baikoff | |
| 4,733,828 | A | 3/1988 | Potts | |
| 4,739,939 | A | 4/1988 | Panning | |
| 4,781,331 | A | 11/1988 | Potts | |
| 4,799,627 | A | 1/1989 | Potts | |
| 4,821,970 | A | 4/1989 | Puetz | |
| 4,971,260 | A | 11/1990 | Taylor | |
| 5,114,082 | A | 5/1992 | Brundick | |
| 5,497,950 | A | 3/1996 | Schrodl | |
| 5,524,839 | A | 6/1996 | Schade et al. | |
| 5,580,010 | A | 12/1996 | Barclay et al. | |
| 5,582,353 | A | 12/1996 | Willibald | |
| 5,680,999 | A | 10/1997 | Wada | |
| 5,697,562 | A | 12/1997 | Lebond | |
| 5,833,153 | A * | 11/1998 | Ackers et al. | 241/192 |
| 5,950,945 | A | 9/1999 | Schaller | |
| 6,092,751 | A | 7/2000 | Kottmann | |
| 7,007,878 | B2 * | 3/2006 | Strong | 241/236 |

FOREIGN PATENT DOCUMENTS

| | | |
|---|---|---|
| EP | 0 420 731 | 5/1991 |
| EP | 2 322 310 | 5/2000 |
| EP | 1 072 314 | 1/2001 |
| GB | 1 107 371 | 3/1968 |
| WO | WO 83/02071 | 6/1983 |

* cited by examiner

*Primary Examiner*—Mark Rosenbaum
(74) *Attorney, Agent, or Firm*—Quarles & Brady LLP

(57) ABSTRACT

A blade for a comminution machine includes a first attack face facing in a first direction to perform comminution when the blade is rotated about an axis of rotation in a first direction. The blade also includes a second attack face facing in a second direction to perform comminution when the blade is rotated about the axis of rotation in a second direction substantially opposite to the first direction. A radial exterior of the first attack face and a radial exterior of the second attack face are connected along an arc subtending at least 30 degrees and less than 110 degrees with respect to the axis of rotation.

22 Claims, 24 Drawing Sheets

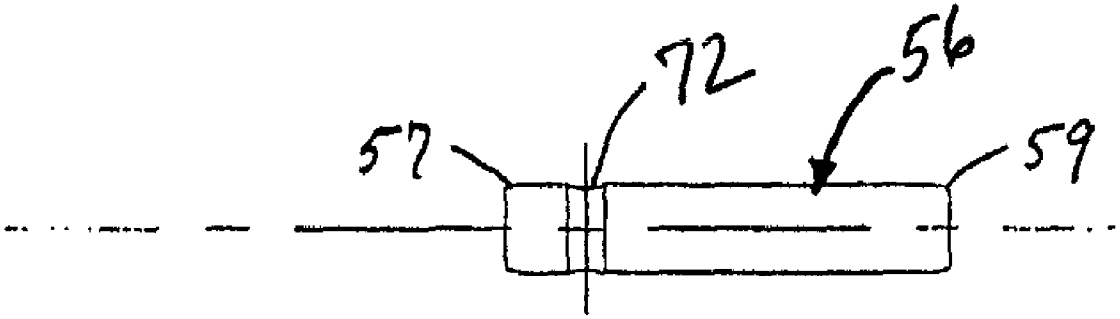
Fig. 8
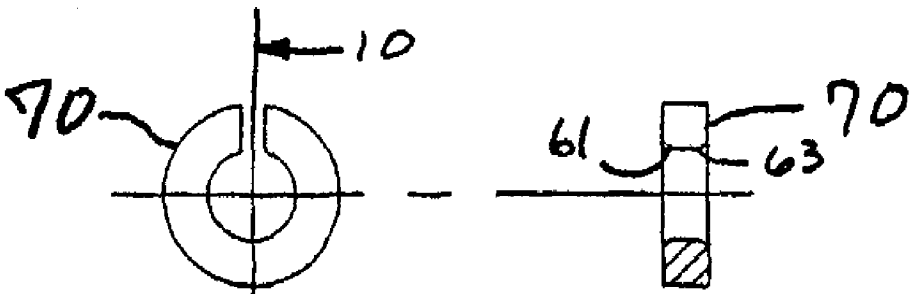
Fig. 10
Fig. 9

REVERSIBLE BLADE FOR A COMMINUTION MACHINE

REFERENCE TO RELATED APPLICATIONS

This application is based on U.S. Provisional Application Ser. No. 60/244,828 filed Oct. 30, 2000, entitled "Comminution Blade", International Application No. PCT/US01/48282 filed Oct. 30, 2001, entitled "Comminution Blade", and a continuation-in-part of U.S. patent application Ser. No. 10/415,516 filed Sep. 5, 2003 now U.S. Pat. No. 7,131,606 and entitled "Comminution Blade".

STATEMENT REGARDING FEDERALLY SPONSORED RESEARCH OR DEVELOPMENT

Not applicable.

BACKGROUND OF THE INVENTION

The present invention relates generally to blades for shredders, mineral reducers, and other types of comminution machines, and, in particular, to a blade system for a comminution machine.

Referring to FIG. 1, a comminution machine, which may also be referred to as a shredder or a mineral reducer, typically includes at least one shaft of polygonal (as illustrated) or keyed section to transmit high torque at low speed mounted by bearings 6 on a frame 10 and driven by a reduction gearbox 8 or hydraulic motor. The frame 10 has two vertical side walls and two vertical end walls which together form a rectangular shape having the top and bottom open. Cleaners 9 (FIG. 3) are fixed to the frame 10 and project into the operating chamber between blades 2 which are separated by spacers 5 on each shaft 1 and arranged helically on the shaft. The blades 2 on one shaft are interleaved with the blades 2 on the other shaft and a minimum clearance exists between the adjacent blades (or a minimum clearance exists between the blades and fixed anvils if only one shaft is used) to produce the cutting action. When two shafts are used, they are rotated in opposite directions. The shafts may be either rotated in synchronization with one another (e.g., so that adjacent teeth on opposite shafts cross an imaginary line between the axes of their respective shafts at approximately the same time), which is preferred since it results in more efficient reduction, or not. Typical prior art comminuting machines are disclosed in patents such as U.S. Pat. Nos. 4,125,228, 4,733,828, 5,799,884, 5,904,305 and 5,992,777, U.K. Patent Application Publication No. 2,322,310 and International Patent Publication No. WO83/02071.

Typical comminution machines allow material to enter at the top of the frame and be processed through the system and discharged through the bottom. The machine may be used for reducing tires, carpet, mattresses, plastic, glass, wood, asphalt or concrete, even concrete with rebar. As such, the blades are subjected to great forces and accordingly to intense wear. Therefore, the blades are typically made by attaching replaceable teeth and wear plates to tooth carriers, with the tooth carriers having a hole in the center which mates with the polygonal (or keyed) shape of the drive shaft so that the tooth carriers are driven by the drive shaft. The number of teeth on each tooth carrier is dependent upon the material being processed and the final size required. It is therefore desirable to have a blade which can be easily adapted to comminute different types of materials.

In a typical prior design, e.g., GB 2 332 310 A, the tooth/blade assemblies were generally circular in shape, with the teeth being mounted in general on the periphery of a cylinder. The surface of the cylinder upstream of each tooth limited the radial depth of the gullet in front of the tooth, and also limited the maximum width of the nip between facing teeth as the teeth approached one another. As a result, the size of the pieces which could be reduced was limited. Another result is that such machines were best suited for minerals not containing ferrous, as opposed to concrete with rebar and/or cable. Such machines worked for smaller materials, such as bricks, but did not work well for larger materials such as larger pieces of concrete or concrete containing rebar and/or cable.

Also, in prior designs, the teeth and wear plates have been attached to the carriers using nuts and bolts. A problem with these attachment systems is that fine particles of the material being comminuted becomes trapped in the threads, making it difficult to replace the teeth and wear plates. The present invention is also directed at a solution to this problem.

BRIEF SUMMARY OF THE INVENTION

The present invention provides a blade assembly which is able to not only efficiently burst, but also efficiently shear materials presented to it. Most notably, a machine of the invention can reduce not only bricks and small pieces of concrete, but also larger pieces of concrete and concrete containing rebar and/or steel cable. A machine of the invention can also reduce other materials such as wood, glass, asphalt, and almost any other material which is either burstable or shearable or both.

A comminution machine of the invention includes a blade having a tooth attack face including a bursting point and also having a receding surface which recedes inward from a tangent line drawn at the base of the attack face of the tooth and has shear edges. Mineral materials such as concrete, brick, rock and glass are broken by the pressure concentrated at the tip of the bursting point and shearable materials such as steel, aluminum, wood, rubber, etc. are sheared by the shear edges.

Preferably, the blade recedes from the tangent line at least 30.degree. forwardly of the attack face to produce a large gullet radially inside of the attack face. The blade may recede in a straight line or a curved line and should be shaped so as to provide a large maximum bite opening, i.e., the distance in front of the tooth within which materials can be compressed, so that large materials can be reduced. The receding surface may continue to a point at which the receding surface is tangent to the axis of the blade, and beyond, to a corner where the receding surface meets a trailing surface, which may also have shear edges. While the depth of bite, i.e., the radial depth, will be relatively small at the maximum bite opening, the depth of bite should rapidly increase as the blade is rotated, before the bite opening closes. Also, in a two shaft system, the receding angle of the receding faces is preferably the same and the rotation of the blades is synchronized so that the receding faces of the blades form a symmetrical V shape when they are facing one another during the bite portion of their cycle, which is the portion of their cycle when they are moving toward one another and capable of compressing materials presented between them. The edges of the receding surfaces of the blade are preferably shear edges, and as such are preferably provided by replaceable elements.

In a preferred form, the tooth has a leading point at its radially outer extremity on its attack face. The point may be formed by a pyramidal structure on the attack face, opposite from the drive face of the tooth, and is provided to perform most of the disintegration or bursting of any ore-type or other burstable materials. In addition, the shape of the point drags or pushes the materials being comminuted radially inward into the shredding area to be operated on by the shearing edges of the teeth and the shearing edges of the receding surfaces (and trailing surfaces) on the wear plates. At the point at which the tooth tips are tangent with a horizontal line at the tops of the tips (position C in FIG. 3B), the attack face of the tips is preferably directed generally downwardly, toward an opening formed by the receding surfaces of the blades, to help draw materials downwardly toward the shear edges of the receding surfaces. Each tooth tip is preferably raked rearwardly from its radially extreme outer point (its bursting point) so as to direct materials radially inward.

In another aspect, the tooth has a forwardly raked base surface on its attack face which extends forwardly from the radially outer portion of the attack face, for example from the base of the bursting point, and is also opposite from the drive surface of the tooth. This helps to grasp materials being reduced and pull them down into the bite. The base surface of the tooth forms shearing edges where it intersects the side surfaces of the tooth so as to cut and shred materials at those edges. The base surface of the tooth is also preferably directed so that for at least a portion of the bite portion of the rotary cycle, i.e., after it passes vertical (position D in FIG. 3B), it tends to push materials radially inwardly toward the receding portion of the blade, which recedes from the base surface of the attack face of the tooth at an obtuse angle.

In the construction of the blade, the forwardly raked base of the attack face preferably leads to similar shearing edge surfaces of wear plates which are attached to the carrier in the receding portion of the blade.

The invention also provides a tooth and wear plate attachment system. The system can be incorporated in a standard comminution machine which has rotating shafts, blades, spacers and wear plates all supported in a box-type frame and driven as described above and is conventional. The cutting teeth and wear plates can be exchanged without dismantling the shaft or shafts, thereby leaving the carriers on the shafts.

In practicing the invention, each separate tooth or wear plate is individually fastened to the carrier by structure on the tooth or wear plate which cooperates with structure on the carrier to secure the tooth or wear plate with a pin spring washer or a securing pin and bolt. The fasteners do not undergo any direct loading from the forces of comminution, and are therefore only subjected to relatively low forces to retain the teeth and wear plates in position. In addition, the pins and washers have no threads and are largely unexposed, except at the ends of the pin, so that they can be easily removed to remove worn teeth or wear plates from the carrier.

In a preferred form, the carrier is machined to accept interchangeable teeth and wear plates which are secured to the carrier by the pin and spring washer, or in the case of an alternate tooth connection, by a securing pin and bolt. In the case of wear plates, each wear plate is three sided, having side walls extending in the same direction from the ends of a connecting wall, and the spring washer is captured between the wear plate and the blade, preferably between a side wall of the wear plate and an axially facing surface of the carrier, with the pin extending through coaxial holes in the side walls of the wear plate and through the carrier. The pin has an annular groove and is shaped so that it can be inserted axially through the spring washer with the spring washer expanding around the pin and snapping into the groove when the washer becomes aligned with the groove, thereby retaining the pin. The pin is removed by impacting the end of the pin so as to expand the washer out of the annular groove, thereby enabling the pin to be driven out of the three coaxial bores.

The forces of comminuting materials are transferred from the teeth and wear plates to the carrier, and are not significantly born by the fasteners which secure the teeth and wear plates. The purpose of the fasteners is simply to maintain the attachment of the teeth and wear plates to the carriers, and not to bear the forces of comminution.

In another aspect of the invention, the receding surfaces can also be formed with tooth structures having points and edges at an aggressive attack angle to the direction of rotation for disintegrating or shredding materials, in addition to shearing them with the edges of the wear plates. Such wear plates can be substituted on a tooth carrier for wear plates which do not have teeth, to adapt the blades (and comminution machine) for different types of materials.

In another aspect, the blade is reversible for efficiently reducing different types of materials.

Various other features of the present invention will be made apparent from the following detailed description and the drawings.

BRIEF DESCRIPTION OF THE SEVERAL VIEWS OF THE DRAWINGS

The invention will hereafter be described with reference to the accompanying drawings, wherein like reference numerals denote like elements, and:

FIG. 8 is a side plan view of a generally cylindrical pin as shown in FIG. 7;

FIG. 9 is an end view of the spring washer shown in FIG. 7;

FIG. 10 is a cross-sectional view from the plane of the line 10-10 of FIG. 9;

DETAILED DESCRIPTION OF THE INVENTION

Figure 1:
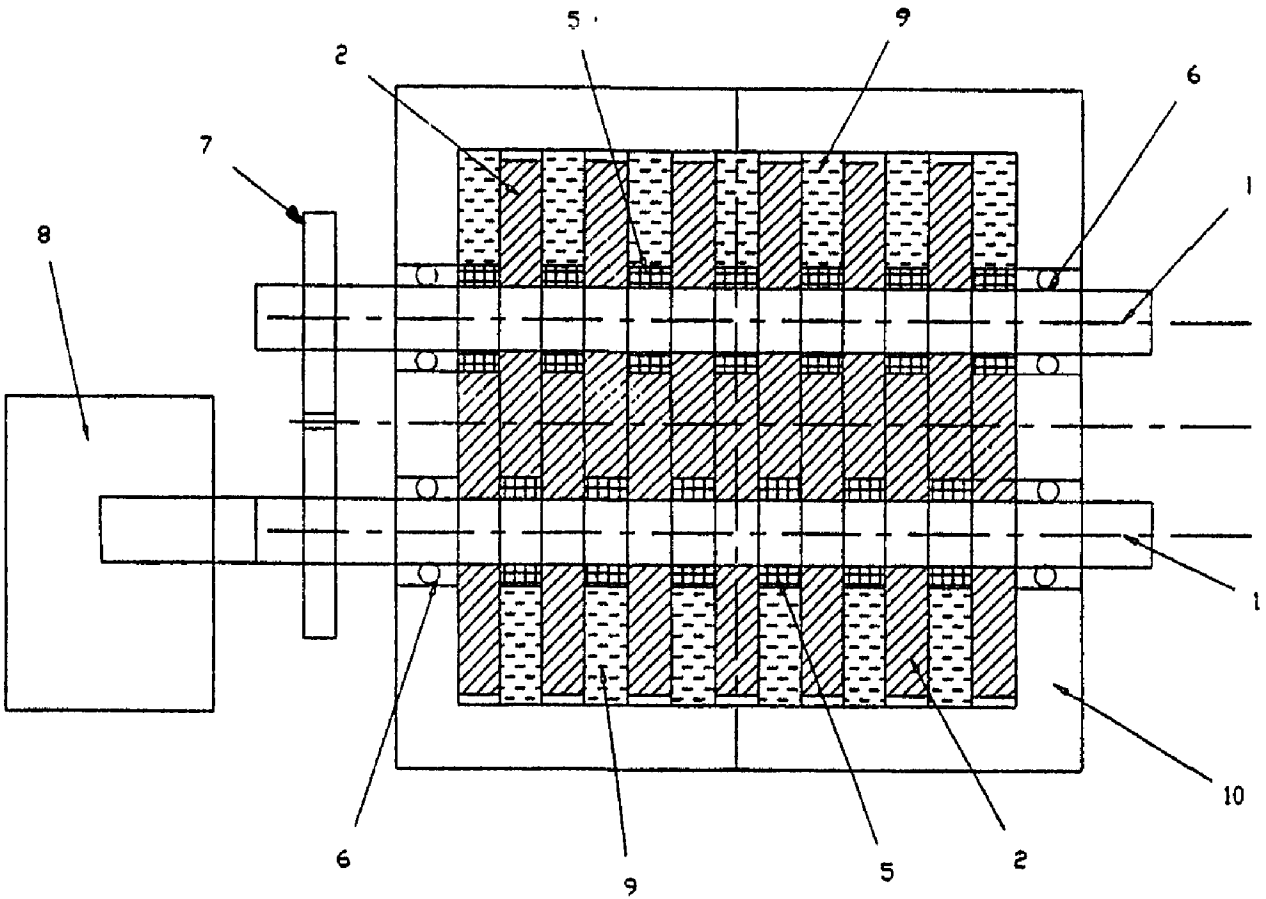
FIG. 1 is a top cross-sectional schematic view illustrating a comminution machine in which the invention is incorporated.
Figure 2:
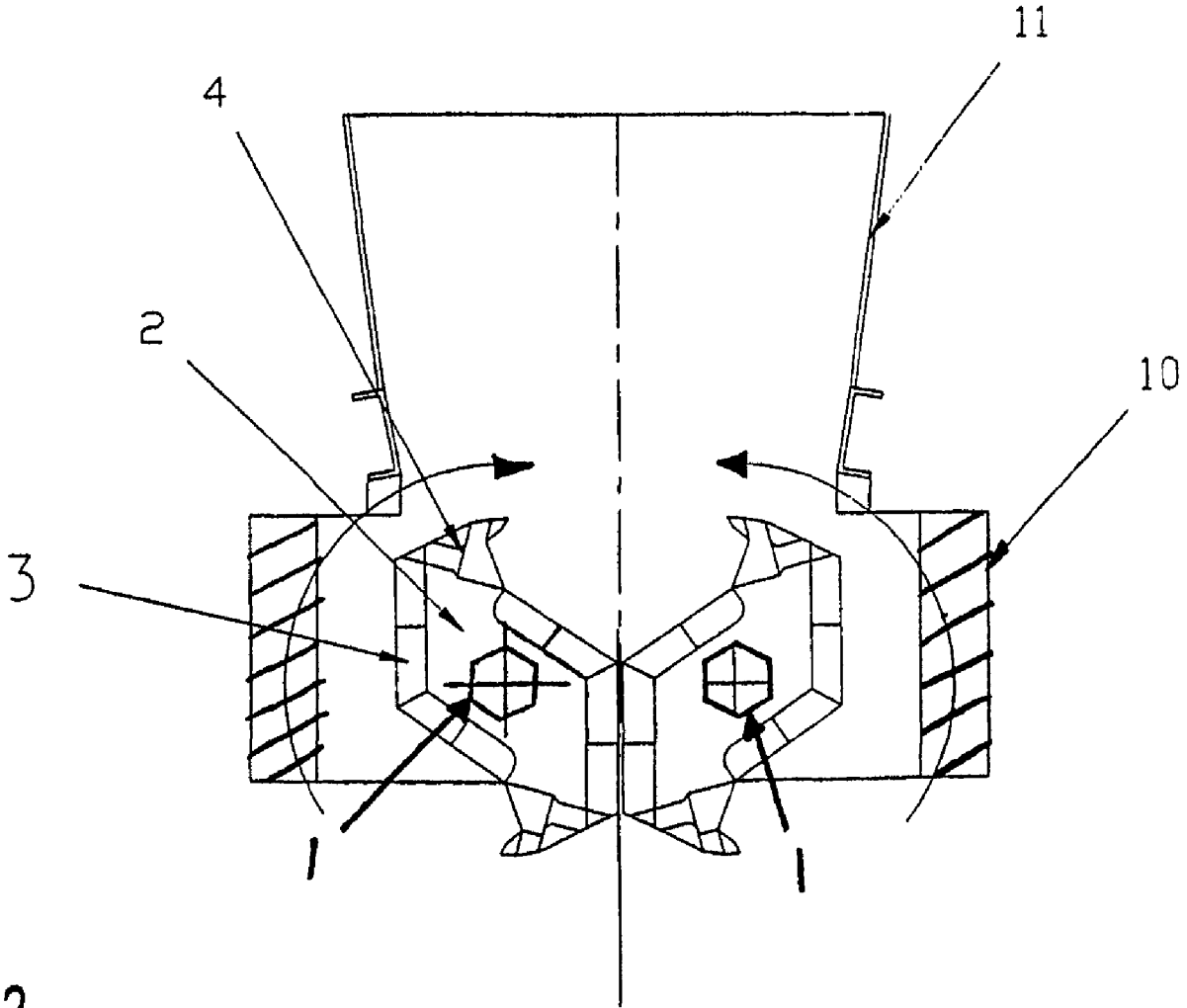
FIG. 2 is a side schematic view illustrating how the blades in the comminution machine of FIG. 1 rotate and coact.

Referring to FIG. 2, the frame 10 may be fitted with a hopper 11 for feeding materials (not shown) to be comminuted to the pair of counter rotating blade assemblies. Also as shown in FIG. 2, it can be seen that the spacing of the shafts 1 is such that a significant amount of radial overlap is provided between the blades as they rotate. In general, the spacing is such that the teeth 4 just barely clear the spacer rings 5 as they rotate. The same is true of the spacing between the sides of adjacent interleaved blades 2, which are close together so as to effect efficient shearing of shearable materials presented to the shear edges of the teeth, receding surfaces and trailing surfaces. As is typical, the blades 2 may be arranged helically on each shaft, so that only one set of adjacent blades pass each other at any one instant in time, so that the torque of the counter-rotating shafts can be concentrated at one set of blades, and so that materials tend to flow axially toward one end of the machine. The angular spacing between the working faces of adjacent blades on each shaft can vary depending on the application, and for large materials to be processed may be 60.degree. for example.

Figure 3A:
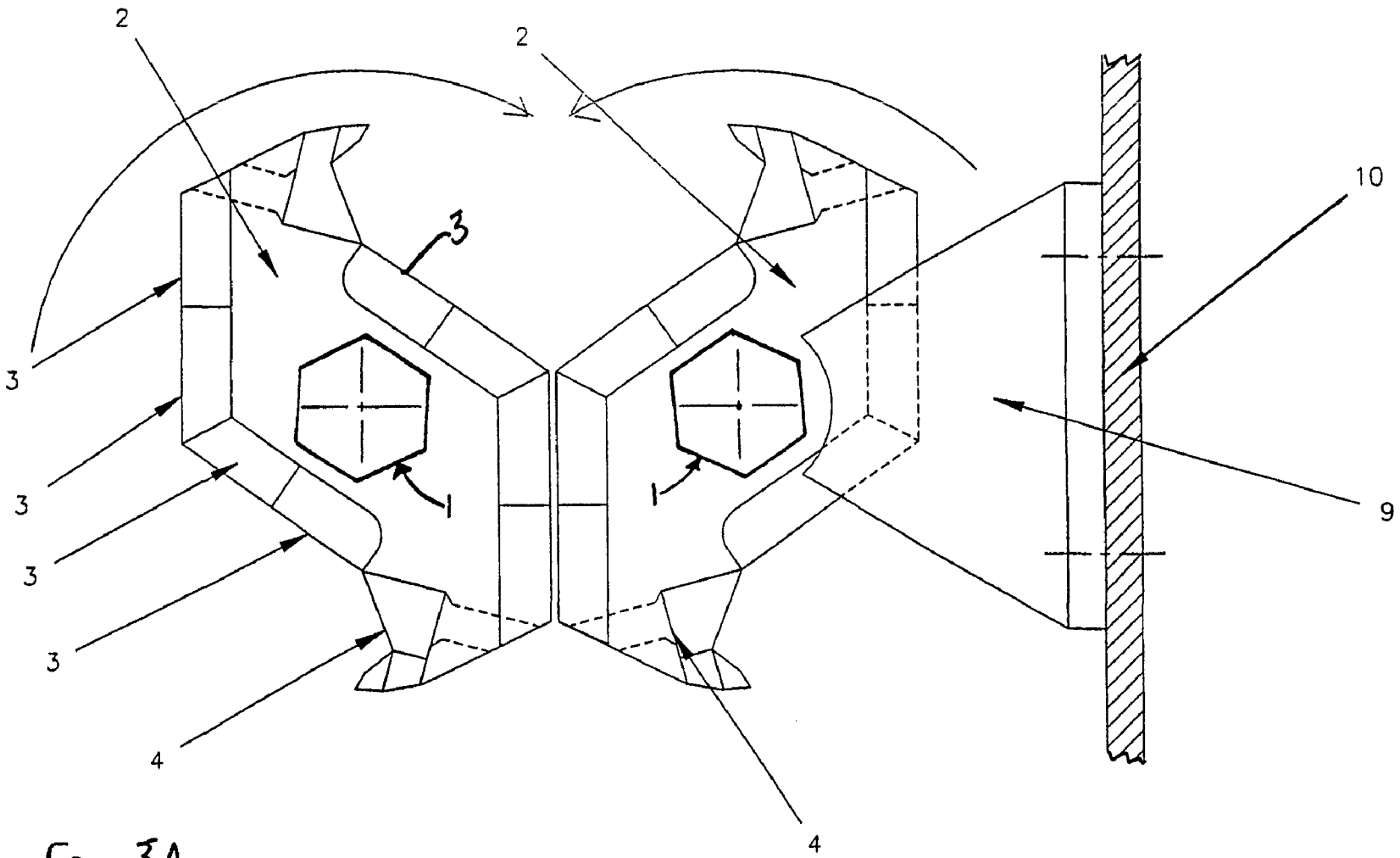
FIG. 3A is a view similar to FIG. 2 also illustrating a cleaner 9 on one side, it being understood that similar cleaners are provided between all of the blades on both sides.

Although not illustrated in FIG. 2, the shape of a typical cleaner plate 9 is illustrated in FIG. 3A. The cleaner plates 9 are provided on the side walls of the frame 10 and extend into the spaces between blades on the adjacent shaft 1 to help clean materials off of the teeth and wear plates before they make another pass through the space between the shafts, which is where most of the down sizing takes place.

Figure 3B:
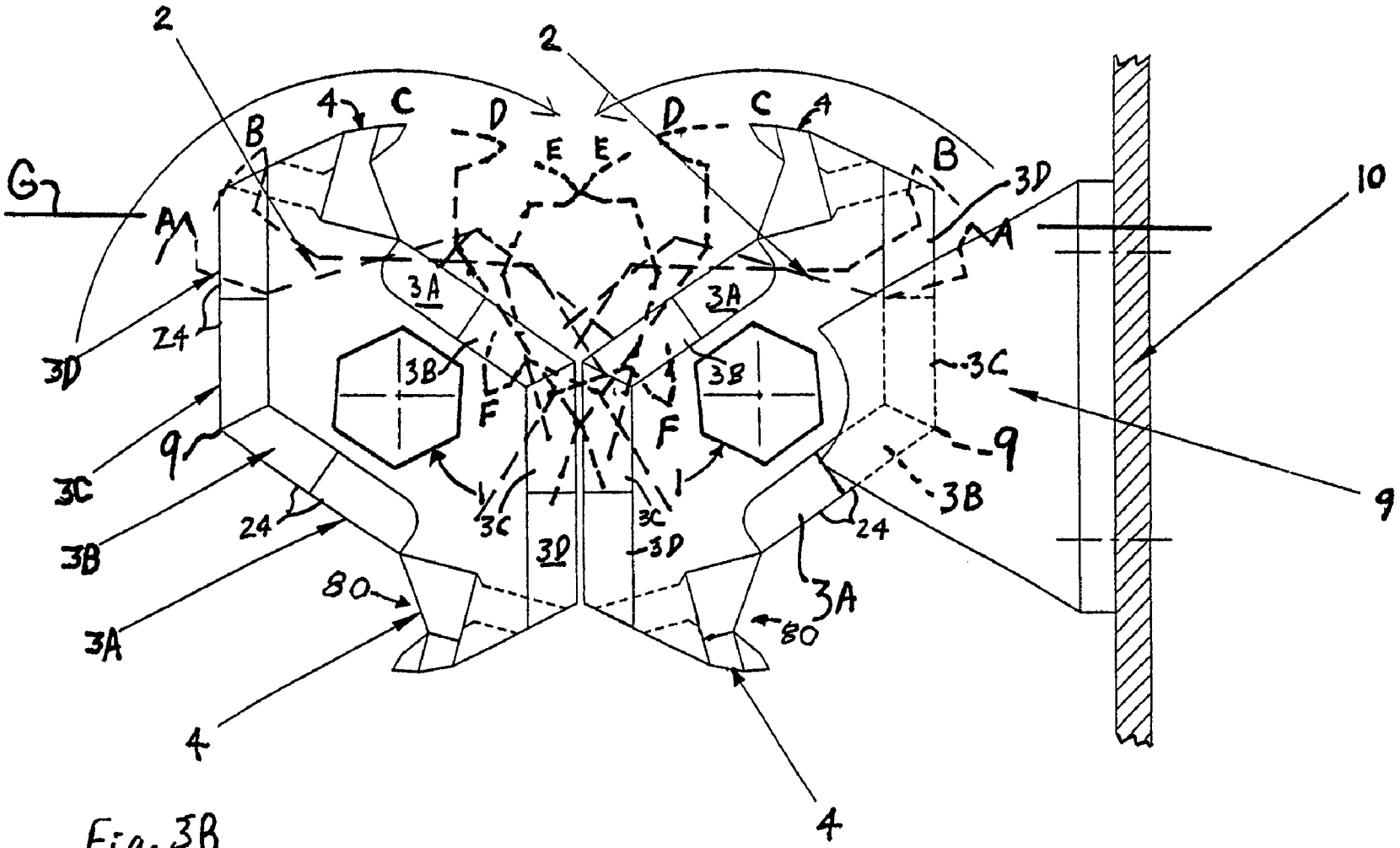
FIG. 3B is a view similar to FIG. 3A, but showing other positions of the blades in phantom as they are rotated through a bite portion of their rotation cycle.

Referring to FIG. 3B, a bite portion of a rotation cycle of the blades 2 will be described. It is typical that the rotation of the shafts 1 is synchronized for maximum efficiency of the blades, so that opposing blades work together to burst and shear materials presented to their attack faces. It is preferred that the rotation of the shafts be synchronized for practicing the invention, but synchronization is not necessary for practicing the invention. Many aspects of the invention may also be applied if the two shafts on which the blades are mounted are not synchronized in rotation, although maximum efficiency is not thereby achieved. However, a benefit in some applications of not synchronizing the rotation of the two shafts, and therefore of the interleaved sets of blades, is that if not synchronized the blades tend to mix the reduced product more. In FIG. 3B, the two adjacent blades illustrated in each of the positions A-E are shown with their rotations synchronized, so that the teeth of the two blades, are in corresponding positions at the same time, i.e., a tooth of the blade on the right is at position A at the same time that a corresponding tooth of the blade on the left is at its position A, with the blades rotating at the same speed in opposite directions. Accordingly, the teeth on the two blades pass corresponding positions in their cycles of rotation at the same time. This yields the most efficient bursting and shearing action. Also, while the shafts 1 are shown as being hexagonal, it should be understood that they could alternatively be keyed or of any other construction to establish a rotary driving connection with the blades 2.

FIG. 3B illustrates six positions A-E of the blades 2 as they are rotated synchronously through a bite portion of their rotary cycle. Position C is shown in full lines and positions A, B and D, E, F are shown in phantom. Each blade has two attack faces. Each blade attack face includes one tooth 4 attack face and the attack faces of the two wear plates 3A, 3B which lead from the base of the attack face of the tooth 4. The attack faces are the surfaces of the teeth (tooth attack face 80) and wear plates (surfaces 24) which confront materials being reduced as the blades are rotated. They are those surfaces which may be said to pinch or crush the materials which are being reduced. All of the attack faces also have side edges which are shear edges such that they can shear materials which get in their way, which in the case of steel reinforced concrete is steel rebar or steel cable.

The attack faces 24 (FIG. 6) of the two wear plates 3A, 3B (FIG. 3B) are referred to herein as the receding surface or the receding attack face because they recede inwardly from a tangent line at the base of the tooth 4 for a significant distance that gives a much greater maximum depth of bite than just the teeth 4 can provide and provides a large gullet, which is the open space in front of the attack faces 24, 80 in which materials can fall to be reduced. The maximum depth of bite is preferably at least about twice the depth of bite provided by the teeth 4 alone. On each side of each blade 2, a corner 9 is between the receding surface and a trailing surface, the trailing surface being defined by the faces 24 of the wear plates 3C and 3D (FIG. 3B) in the preferred embodiment. Since each blade 2 has two sets of attack faces 24, 80, there are two bites for each complete revolution of the shafts 1.

Figure 13:
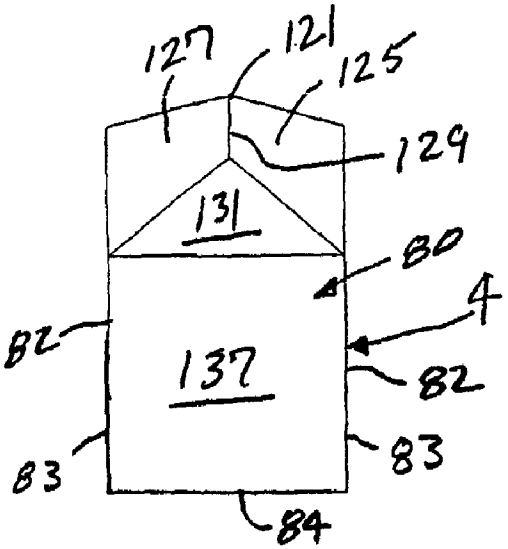
FIG. 13 is a plan view of the attack face of the tooth of FIGS. 11 and 12.

Position A in FIG. 3B illustrates two adjacent blades 2 just entering a bite portion of their revolution, with the tooth tips or bursting points 121 (FIGS. 11-13) generally aligned along a horizontal line G with the corners 9. In this position, the tooth tips 121 could start to crush material between them, and so this is the start of the bite portion of the cycle of revolution. Hereinafter, the horizontal line G may also be referred to as the plane of compression, because it is at this point in the rotation of the blades 2 that materials may begin to be compressed between the tooth tips 121. The tooth tips 121 at this point are widely spaced and approaching one another, but the depth of bite is quite small, most materials being supported above any crushing or shearing action by the corners 9 or the receding or trailing faces. Thus it can be seen that the plane of compression G occurs at tooth tip position A, which is about 50.degree. in advance of the top, or 12 o'clock, position of the tooth tips (position C), which is where the tooth tips 121 are at their highest position, moving directly toward each other horizontally. This angle of advance should preferably be more than 45.degree. and preferably as large as possible, to effectively process large pieces, and is made possible by the large open gullet of the blade in front of the tooth attack face and in front of the receding surface.

It is also desirable that the receding surface extend from the tooth attack face 80 inwardly from a tangent line at the base of the tooth 4 for a distance such that a horizontal gullet (i.e., the horizontal space) in front of the tooth attack face 80 is open and unobstructed by the blade 2 in an angular position of the bursting point 121 which is at least 30.degree. in advance of the 12 o'clock position of the bursting point 121 (position C in FIG. 3B). This allows larger materials to fall into the path of the oncoming tooth attack face so as to be reduced thereby, and particularly to fall somewhat below the bursting point 121, so that the tooth 4 can move them further downwardly toward the shear edges of the receding surface.

In addition, it is preferred that the receding surface be of a significant length, to provide relatively long shear edges, and that it be raked forwardly from a radial line through the bursting point 121 of the tooth 4 from which the receding surface extends. Thus, it is preferred that the receding surface extend for at least 30.degree. in front of the bursting point 121 of the tooth 4 from which the receding surface extends. The receding surface can extend to a point at which the receding surface is itself tangent to the axis of the blade 2, which occurs near the break between the plates 3A and 3B (FIG. 3B), but still on the plate 3A. From that point on, the receding surface continues along its straight line path, so that it is extending radially outward from that point on, to the corner 9, where the receding surface meets the trailing surface, which is the attack faces 24 of the plates 3C and 3D.

Further revolution from position A deepens the depth of bite, with still relatively large width of bite so as to permit the reduction of large materials. In addition, a relatively smaller V-shaped notch is formed between the two corners 9 by the trailing surface on plates 3C and 3D, where great crushing and shearing forces can be developed for smaller materials, since they are relatively close to the axes of the shafts 1. Thus, some crushing can be performed by the trailing surfaces, and some shearing can be performed by the side edges of the trailing surfaces of the plates 3C and 3D as they pass by one another.

As the blades 2 continue their revolution to position B, the depth of bite increases rapidly as the corners 9 move down, the tips 121 move up and the receding surfaces (attack faces of plates 3A and 3B) become aligned along a straight line. At this point, the bite width has not been reduced much from the first position, and the bite depth has increased more significantly, so that large materials of significant depth can be compressed between the converging teeth 2. In addition, a V-shaped notch still exists between the trailing surfaces (attack faces of plates 3C and 3D), so that it is still possible to crush and shear smaller materials with high force in this position.

In position C, the tooth tips 121 are tangent to a horizontal line and so they are moving directly toward one another for maximum crushing action. In this position, there is still significant spacing between them, so large materials can be crushed, and the maximum depth of bite, i.e., the maximum vertical dimension of the usable gullet radially inward of the tooth tips is very large (e.g., 12 inches or more), since the surfaces of the facing plates 3A and 3B recede radially inwardly to where they almost intersect at the corners 9, with the corners 9 much closer to the level of the axes of the shafts 1 than are the bases of the attack faces of the teeth 4. Thus, for more than 45 degrees, nearly 90 degrees in the preferred embodiment, in front of the bursting points 121, the attack face of each blade 2 increases in depth of bite, i.e., in the vertical distance from the tooth path in position C of the blades, where the tooth tips are tangent to a horizontal line. Preferably, the maximum depth of bite should be at least twice the depth of bite provided by the teeth alone, and preferably it should be as large as possible, considering the extreme forces to which the blades are subjected. This provides the huge gullet which can reduce materials which are large in both the distance from tooth tip to tooth tip (bite width), but also large in height (bite depth).

Past position C, the volume of the gullet starts to be reduced more rapidly as rotation continues and there is little chance of escape of materials caught therein. The tooth tips 121 extending forwardly in the direction of rotation and facing downwardly inhibit materials from coming out of the gullet, particularly past position C, where they have a vertically downward component to their direction of motion and the distance between them is rapidly decreasing. At position D, the surface at the base of the tooth attack face is generally vertical so those faces are moving directly toward one another at this position in the rotation cycle.

The configuration of the tips 121 being at the radially outermost point of the tooth attack face and the open area with shear edges beneath them helps draw rebar, cable and other shearable materials down into the area of the shear edges on the teeth and wear plates where those materials can be sheared. At position E, the tooth tips 121 close off the top of the gullet and at position F the tips have passed one another and are tangent to a vertical line, driving material downwardly. This marks the end of the bite cycle.

It should also be noted that materials that resist shearing, for example, ore-type materials like concrete, brick and stone, are pushed upwardly by the receding surfaces (attack faces 24 of plates 3A and 3B) when moving from positions B to E to be burst by the teeth 4, and particularly by the tooth tips 121.

Thereby, a blade of the invention is effective to reduce ore type materials and also shear shearable materials, and to do so on materials which are large in size, e.g., having dimensions up to twelve inches, and which are composite materials including ore type and shearable materials, such as concrete containing rebar and/or cable. By providing a large gullet, both in width and depth, bursting points radially outward and uniquely angled and oriented attack faces and shear edges, the blade is able to reduce a large variety both in terms of size and type of materials.

Figure 4:
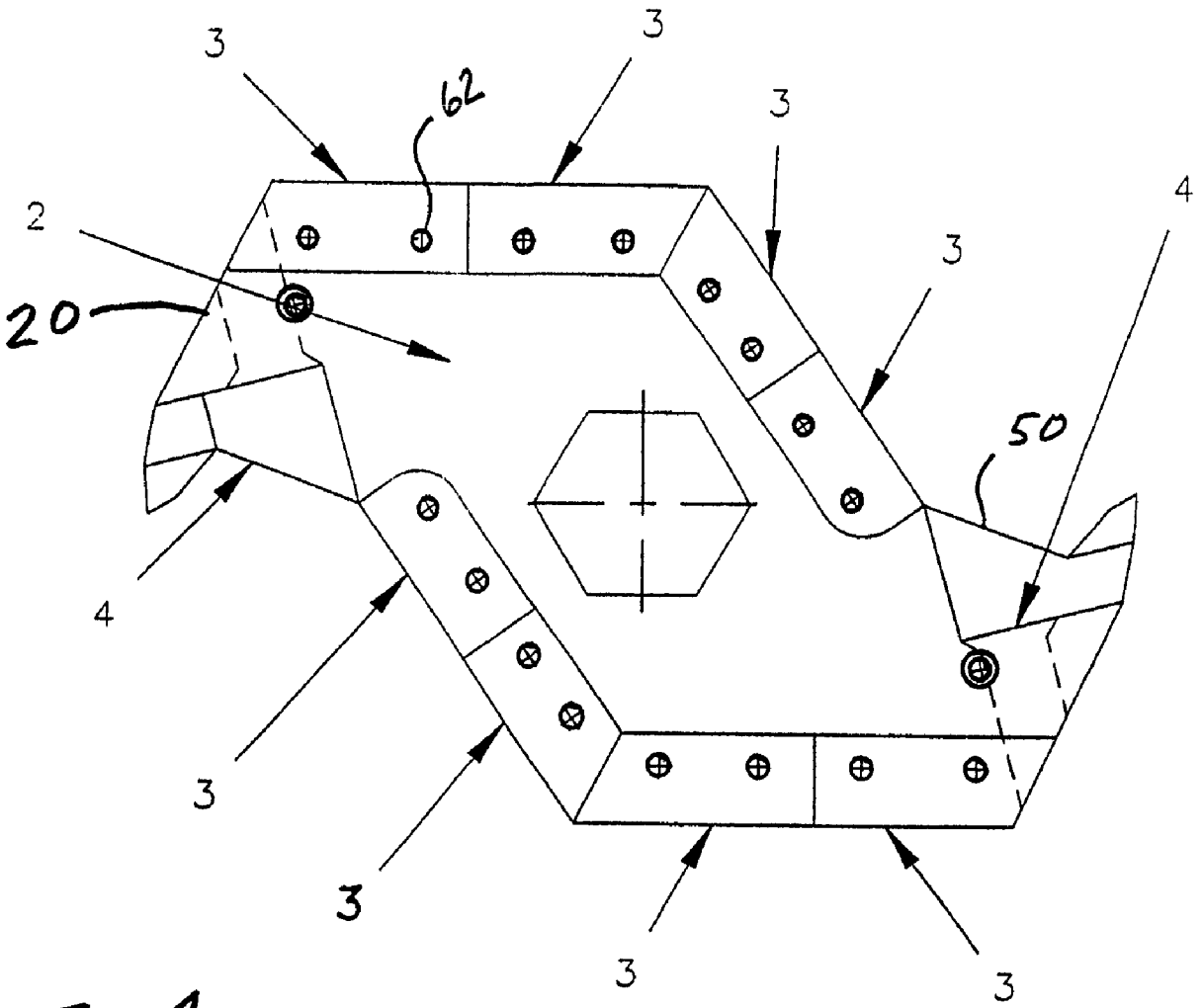
FIG. 4 is a plan view of a single blade incorporating the invention, showing additional details of the blade.
Figure 6:
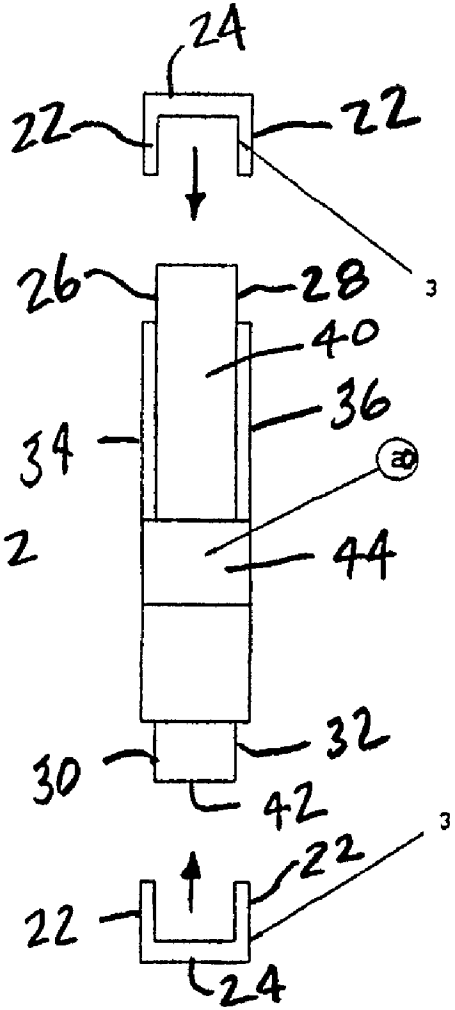
FIG. 6 is a front plan view showing wear plates exploded from the carrier of FIG. 5.

Referring to FIGS. 4-10, the attachment of the wear plates 3 to the carrier 20 will be described. Referring particularly to FIG. 6, while the wear plates 3 may have different side profile shapes as shown in FIG. 4, depending upon where on the carrier 20 they are located, they each have a generally U-shaped cross sectional shape as shown in FIG. 6, having a pair of parallel side walls 22 joined integrally to the ends of a connecting wall 24. Correspondingly, the carrier 20 has the thickness of its edges which receive wear plates 3 reduced on both sides so as to form side surfaces 26, 28, 30 and 32. The surfaces 26 and 30 and surfaces 28 and 32 are inset from the interior portion 34, 36 which they are adjacent to by a distance approximately equal to the thickness of the side walls 22 so that the outer surfaces of the side walls 22 are approximately flush with the surfaces 34 and 36 when the wear plates 3 are assembled to the carrier 20. Similarly, the edge surfaces 40 and 42 are stepped down from the corresponding base surfaces 44 and 46 by a distance approximately equal to the thickness of the connecting wall 24 to provide a generally continuous transition from the base 50 of the attack face of the adjacent tooth 4 to the adjacent wear plate 3. The portion of the carrier 20 which is reduced in thickness and recessed from the surfaces 44 and 46, i.e., that portion to which wear plates 3 are attached, will hereafter be referred to as the flanges 52 and 54 of the carrier 20.

Figure 5:
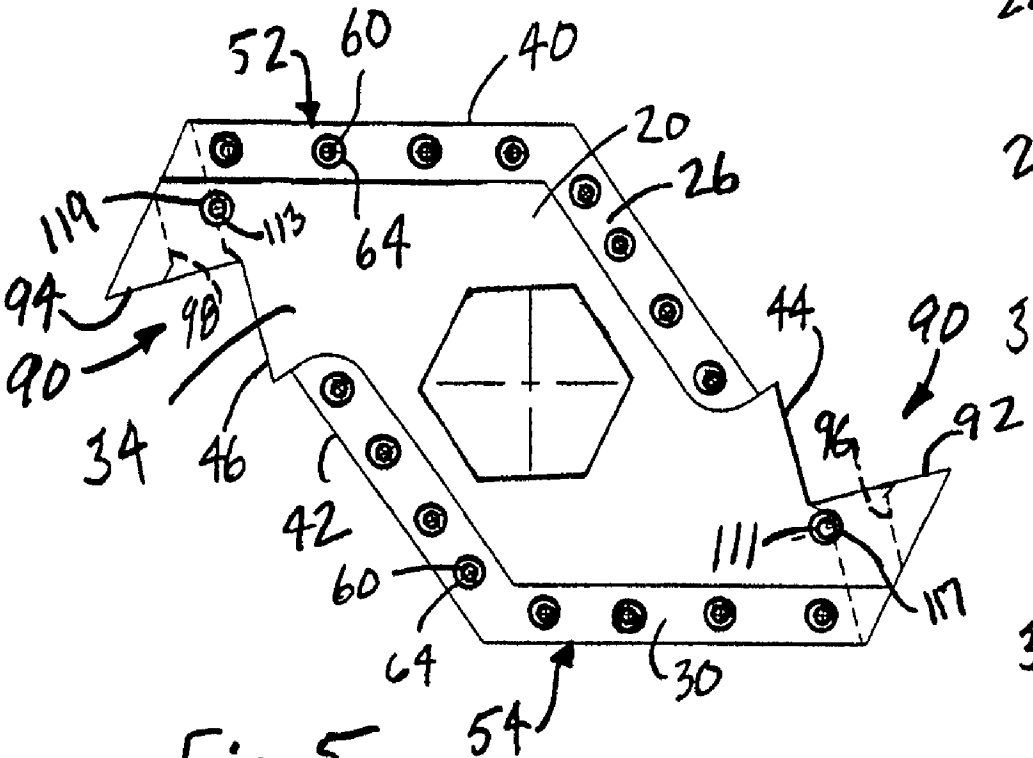
FIG. 5 is a side plan view of a tooth and wear plate carrier for practicing the invention.
Figure 7:
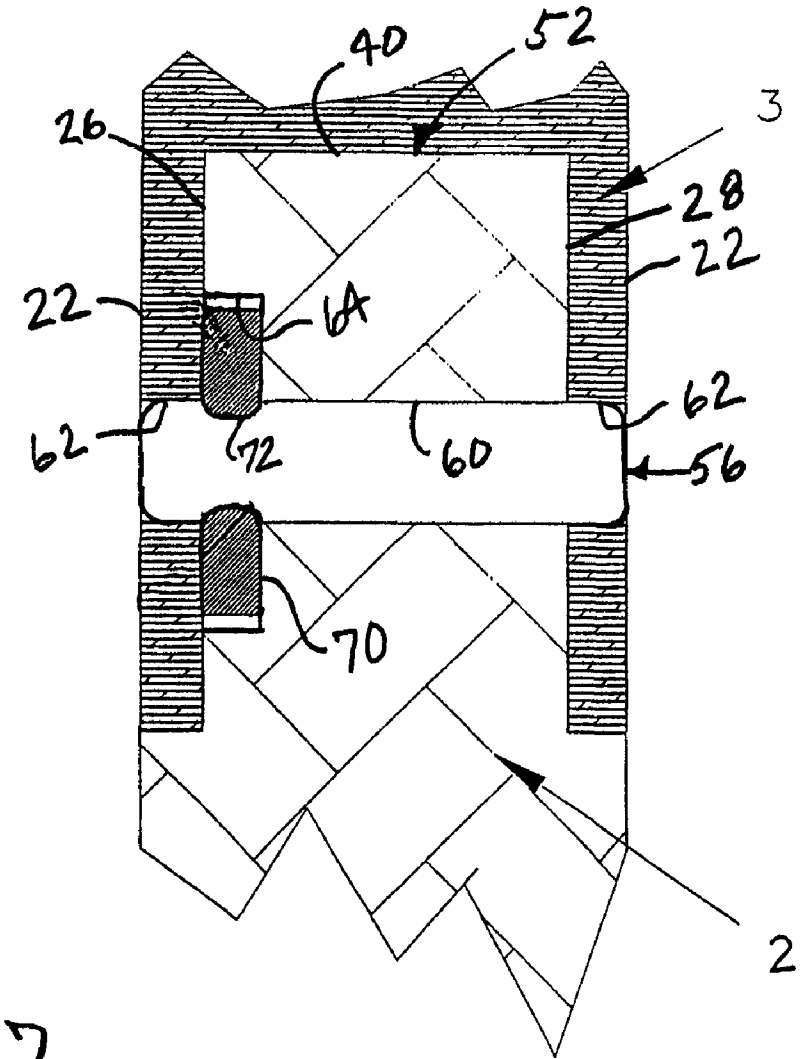
FIG. 7 is a cross-sectional view illustrating the attachment of a wear plate to the carrier using a pin and spring washer.

Each wear plate 3 has formed in each of its side walls 22 coaxial bores 62 just slightly larger in diameter than pin 56 (FIGS. 7 and 8). Corresponding coaxial holes 60 are formed in the flanges 52 and 54. Since the holes 60 and 62 are coaxial, a pin 56 can be inserted through the holes to retain the wear plates 3 on the respective flanges 52 and 54. However, on one side of each flange 52 and 54, for example on side 26 as illustrated in FIG. 5, a counter bore 64 (FIGS. 5 and 7) is provided around the hole 60 which is slightly larger in diameter than the outer diameter of the spring clip 70 (FIGS. 9 and 10). The ends of the pin 56 are tapered at 57 and 59 as shown in FIG. 8 and the inner edges of the spring clip 70 are also tapered at 61 and 63 as shown in FIG. 10 so that as the pin 56 is forced axially into the spring clip 70, the clip 70 flexes radially in the counter bore 64. The counterbore 64 is larger in diameter than the clip 70 to provide clearance for the clip 70 to flex open. As the pin 56 is pushed through the clip 70, the inner diameter of the clip 70 slides along the outer diameter of the pin 56 until the rounded annular groove 72 is reached, at which point the clip 70 snaps into the groove 72 to retain the pin 56 axially, with the center part of the pin in the bore 60 and the ends of the pin extending into the bores 62 in the side walls 22. The clip 70 is trapped between the inner axially facing surface of side wall 22 (on the left of FIG. 7) and the axially facing surface of counter bore 64. The pin 56 can be driven out of the bores 60 and 62 by impacting the end of the pin 56, for example with a punch, in which case the spring clip 70 expands out of the annular groove 72, helped by the rounded confronting shapes of the clip 70 and groove 72, and slides along the outer diameter of the pin 56 until the pin 56 is driven completely out of the spring clip 70. A new wear plate 22 can then be installed by sliding it over the flange 52, aligning the holes 62 with a pair of holes 60, and reinstalling the pin 56.

The teeth 4 are also secured to the carrier 20 using a pin 56 and split-spring clip 70 for each tooth. Referring to FIGS. 11-15, each tooth 4 has a generally cylindrical shank 76 extending from its rearward drive face 78, which is opposite from its attack face 80. Side walls 82 join the drive face 78 and the attack face 80. A base face 84 intersects the side faces 82, the attack face 80 and the drive face 78 and is generally parallel with the axis of the shank 76. Opposite from the base surface 84, an end surface 86 defines the tooth 4.

Figure 11:
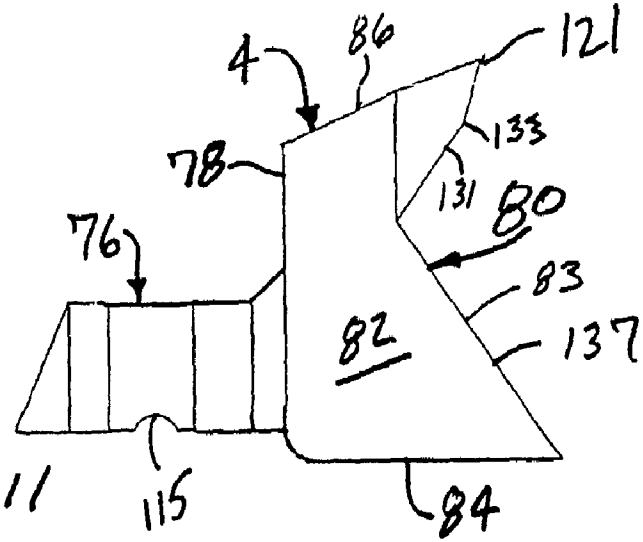
FIG. 11 is a side plan view of a tooth for practicing the invention.
Figure 12:
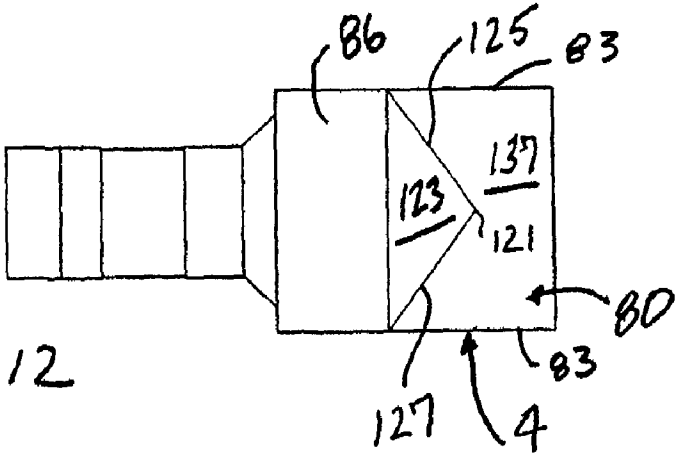
FIG. 12 is a top plan view of the tooth of FIG. 11.

Correspondingly, referring to FIG. 5, each carrier 20 has a pair of tooth receivers 90, each tooth receiver 90 including a base surface 44 or 46, a drive surface 92 or 94 generally perpendicular to the adjacent base surface 44 or 46, and a cylindrical bore 96, 98 which intersects the corresponding drive surface 92 or 94. The ends of the bores 96 and 98 are chamfered where they intersect the respective surfaces 92 and 94, to receive the similarly chamfered surface of the shank 76 (not chamfered on bottom as shown in FIG. 11). Thus, the shank 76 is inserted into the corresponding bore 96 or 98, with the base surface 84 of the tooth in close facing proximity to the corresponding base surface 44 or 46 and the drive surface 78 seated against the corresponding drive surface 92 or 94. The base surfaces 44, 46 keep the teeth from rotating and the drive surfaces 92, 94 impart the driving forces on the teeth which drive them to comminute the materials being reduced by the machine.

Figure 15:
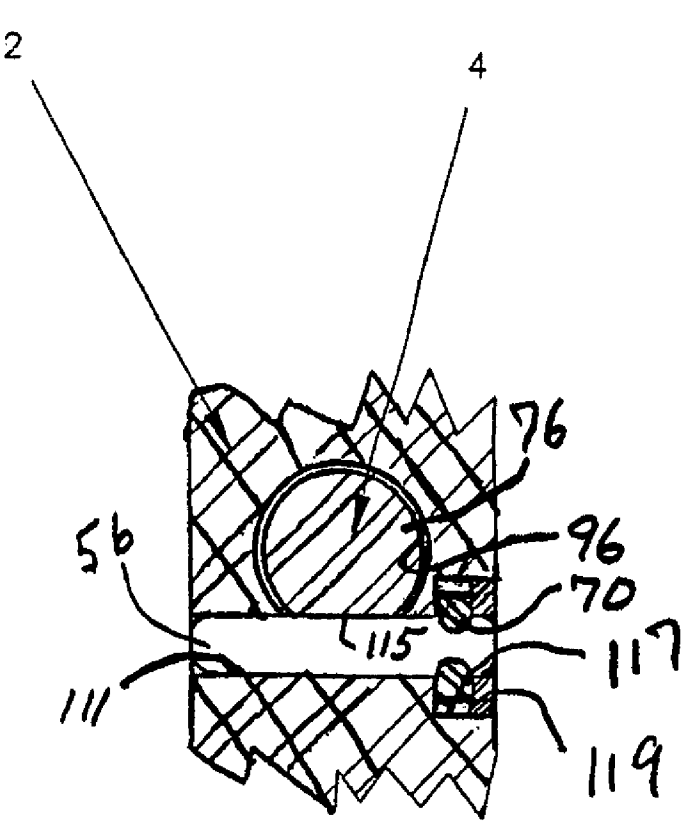
FIG. 15 is a cross-sectional view from the plane of the line 15-15 of FIG. 14.
Figure 14:
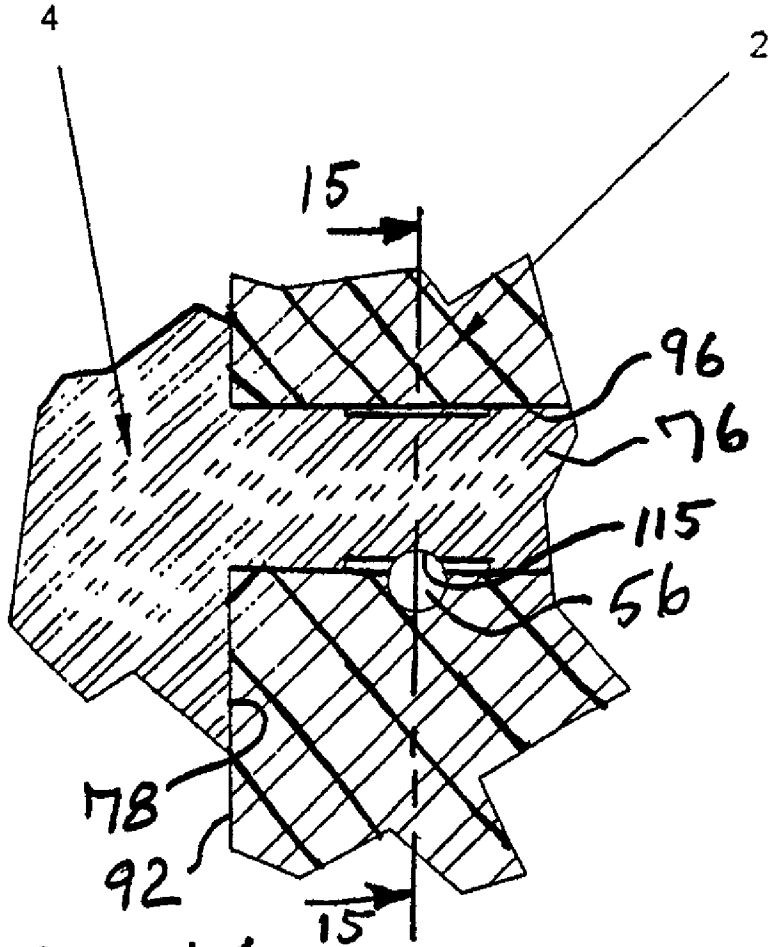
FIG. 14 is a cross-sectional view through the axis of the shank of a mounted tooth and through a pin.

To retain the shanks 76 in their respective holes 96 or 98, referring to FIGS. 14 and 15, bores 111, 113 are formed in the carrier 20, with axes parallel to the axes of the drive shafts 1 and which at least partially intersect the respective bores 96 and 98. A recess 115 is provided in the shank 76 running transverse to the axis of the shank 76, to provide clearance for the pin 56 at permit it to at least partially pass through the shank 76. A counter bore 117 or 119 is formed around the respective bore 111 or 113 which is slightly larger in outer diameter than the spring clip 70 so that the spring clip may flex outwardly out of the annular groove 72 to release the pin 56 when it is driven into or out of engagement with the spring clip 70. The counter bore 117 is capped off with a annular washer 119 which is welded to the outer surface of the carrier 20. Therefore, the pin 56 will interfere with the recess 115 if the shank 76 attempts to move axially relative to the carrier 20. No significant forces are born by the pins 56, as they only prevent the teeth 4 from falling out of the bores 96, 98.

The attack faces 80 of the teeth 4 are shaped to have a radially outer bursting point 121 formed by the intersection of pyramidal surfaces 123, 125 and 127. Line of intersection 129 between the side surfaces 125 and 127 is raked rearwardly at an angle and forms minor point 133 with surface 131, which intersects the sides surfaces 127 and 125 at their radially inward edges. Surface 131 is raked rearwardly at a steeper angle than the line 129 and at its base, which is as wide as the attack face 80, intersects forwardly raked base surface 137 of attack face 80. Forwardly raked surface 137 forms right angles with the side walls 82 of the tooth 4 to create sharp shear edges 83 therewith which do much of the shearing action of the materials being comminuted. Bursting point 121 concentrates a force at it, and line 129 also, to break up ore-type materials such as concrete, brick, stone, glass or other more brittle materials. Bursting point 121 is shown as being a relatively sharp point, but the term is intended to include any relatively small area at which pressure is concentrated adequate to burst burstable materials such as concrete, brick, stone and/or glass. The rearwardly raked surfaces of the line 129 and surface 131 help to feed material radially inwardly toward the shearing edges 83 which are provided by the intersection of surface 137 with side surfaces 82, and by the receding surface of the blade. In addition, as best seen in FIG. 3, the radially innermost edge of surface 137 meets the radially outer most edge of the adjacent wear plate 3 in a line of contact so as to provide a smooth transition for additional shearing of the material by the edges of the receding surface on the wear plates 3A and 3B formed at the intersection of the connecting wall 24, also referred to as the receding surface attack face 24, and the side walls 22 of the wear plates 3A and 3B.

Figure 16:
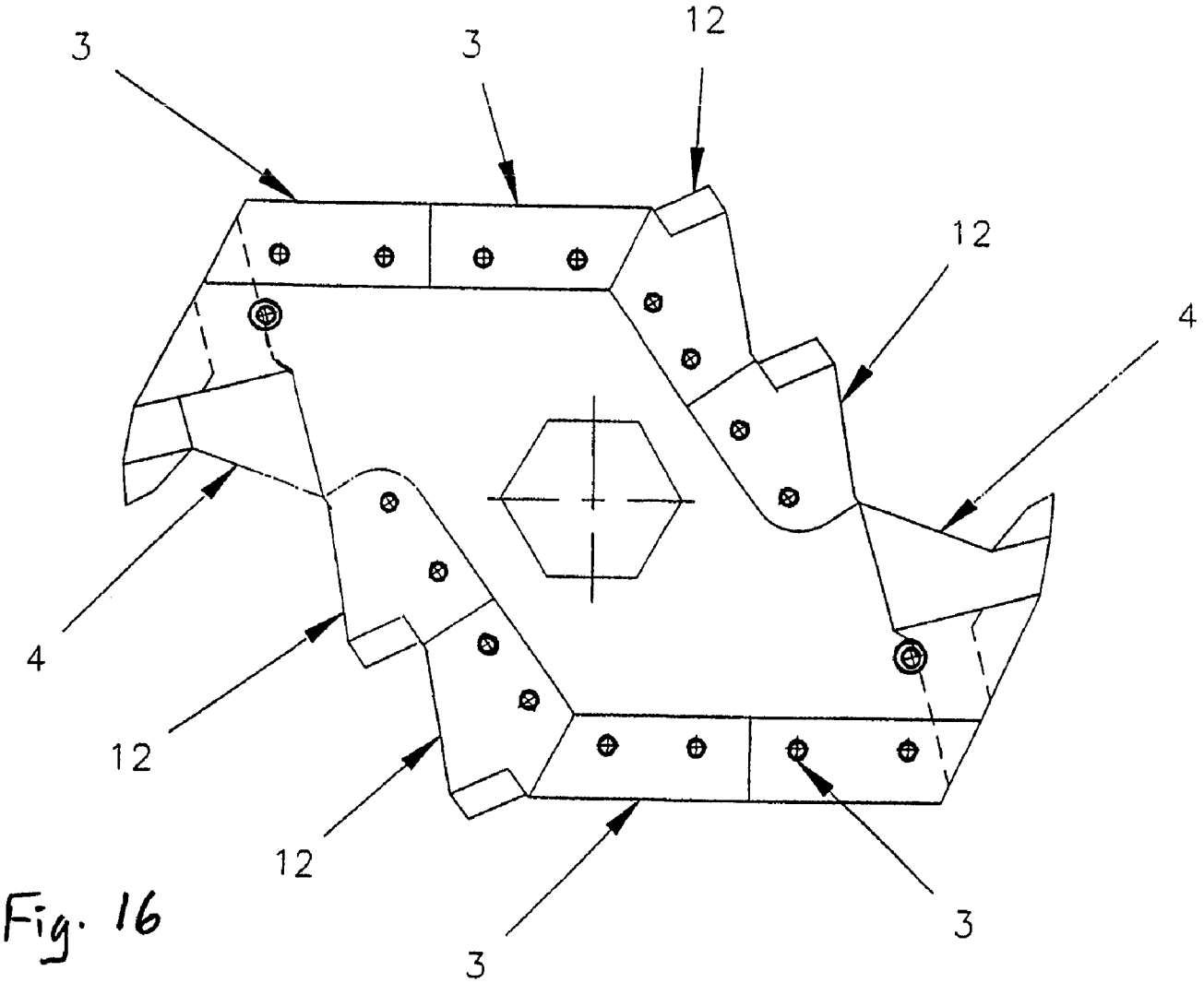
FIG. 16 is a view similar to FIG. 4 but showing the blade fitted with alternate wear plates which incorporate teeth.

FIG. 16 illustrates a blade with four alternative wear plates 12 which have teeth integrated into them. These are further illustrated in FIGS. 17-19. The attachment of the combined tooth/wear plates 12 is the same as the attachment of the wear plates 3 previously described. The use of the wear plates 12 rather than the wear plates 3 reduces the size of the gullet and therefore produces a smaller product. Whereas with the wear plates 3, the maximum size produced may be approximately 8.times.33/4.times.33/4 inches, using the wear plates 12, the maximum product size may be about 5.times.33/4.times.33/4 inches.

Figure 19:
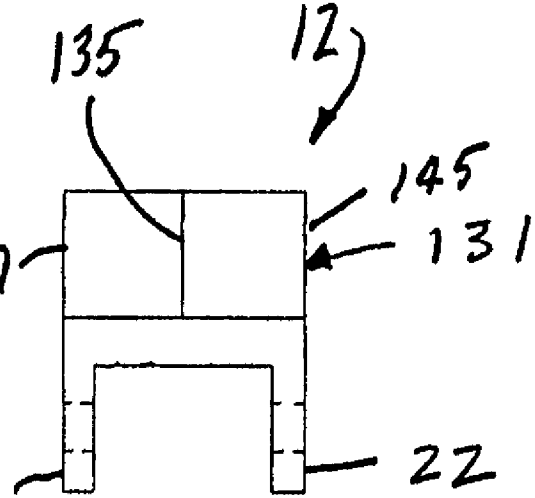
FIG. 19 is a front plan view showing the attack face of the wear plate of FIGS. 17 and 18.
Figure 17:
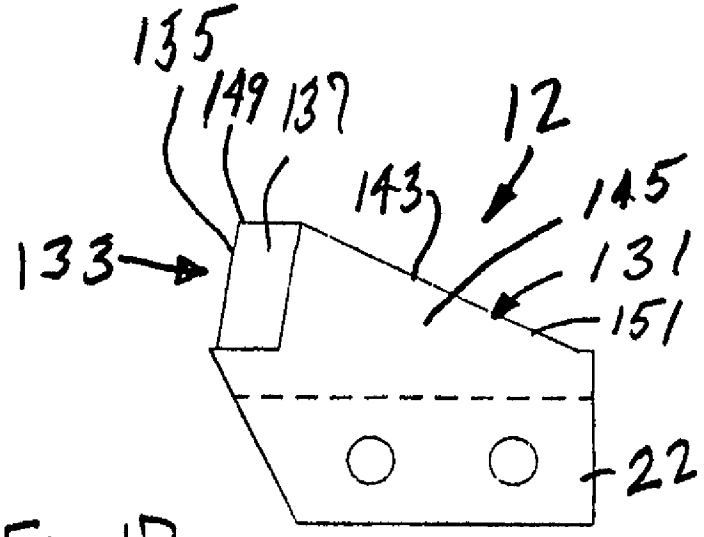
FIG. 17 is a side plan view of one of the alternate wear plates used in FIG. 16.
Figure 18:
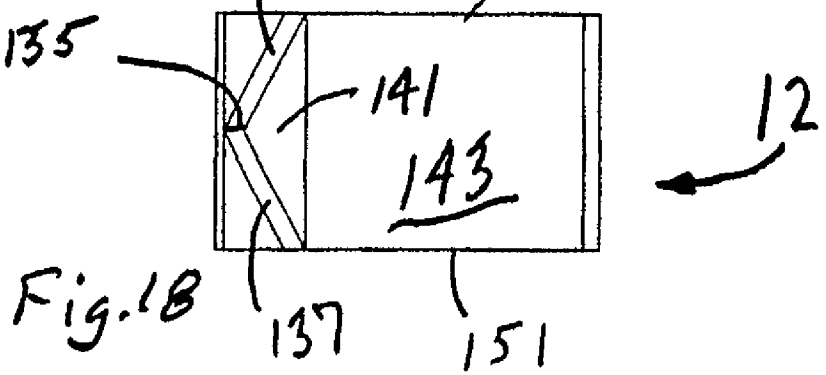
FIG. 18 is a top plan view of the wear plate of FIG. 17.
Figure 20:
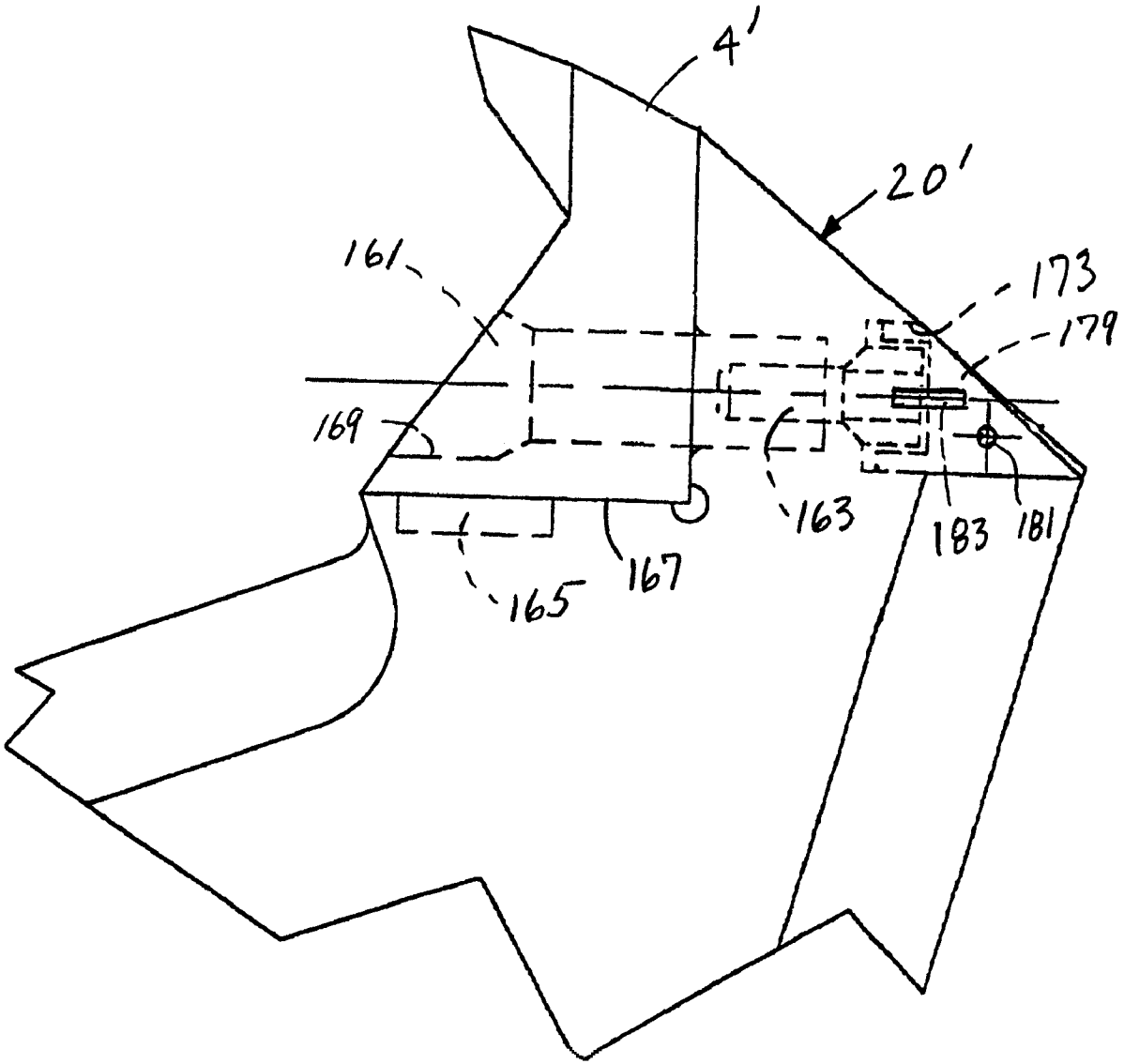
FIG. 20 is a fragmentary view of a portion of an alternate tooth carrier with an alternate tooth attached, illustrating an alternate tooth attachment.
Figure 23:
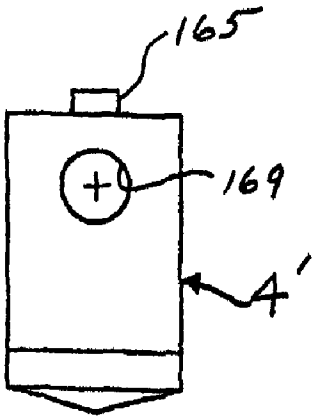
FIG. 23 is a rear plan view of the alternate tooth of FIGS. 20-22.
Figure 21:
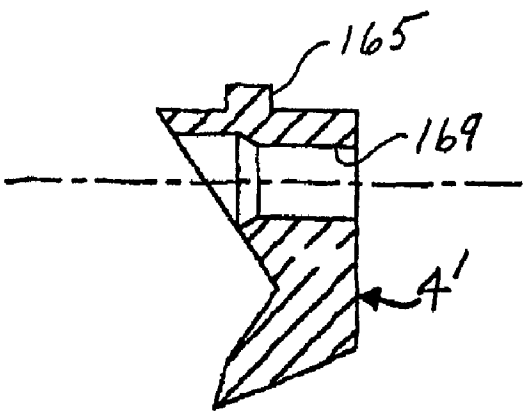
FIG. 21 is a sectional view of the alternate tooth of FIG. 20.
Figure 22:
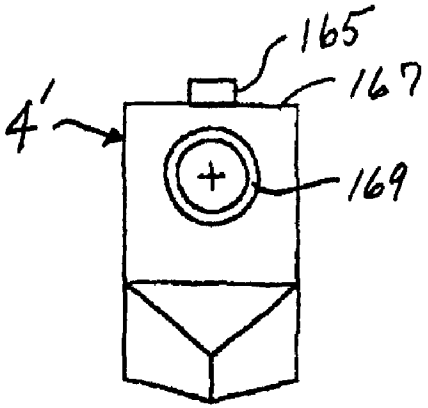
FIG. 22 is a front plan view of the attack face side of the alternate tooth of FIGS. 20-21.
Figure 24:
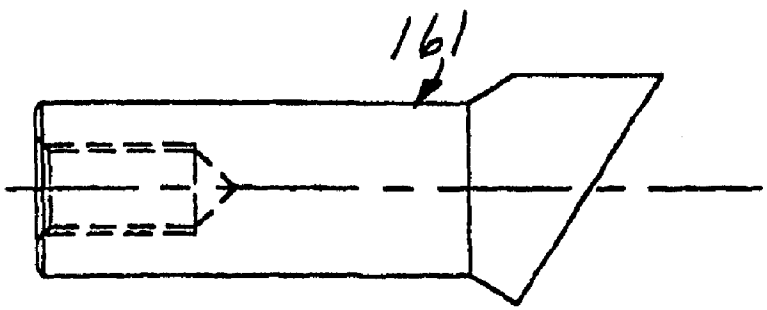
FIG. 24 is a side plan view of a securing pin for the alternate connection shown in FIG. 20.
Figure 25:
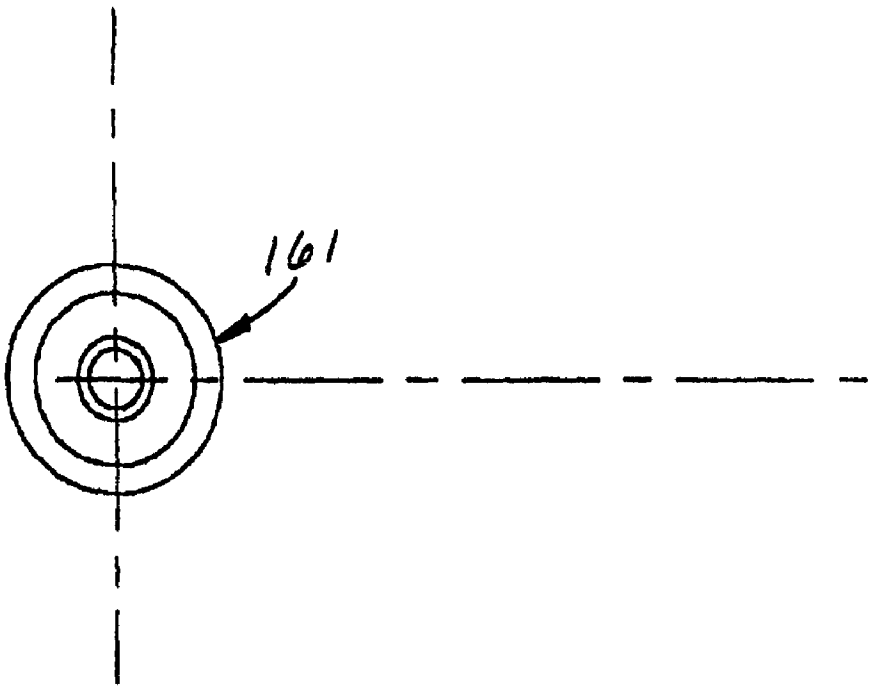
FIG. 25 is an end plan view of the bolted end of the securing pin of FIG. 24.
Figure 26:
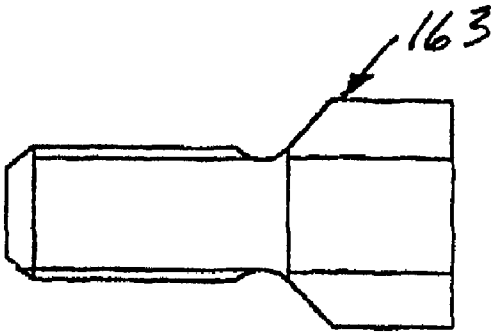
FIG. 26 is a side plan view of a bolt for bolting the securing pin of FIGS. 24 and 25 in the alternate connection of FIG. 20.
Figure 27:
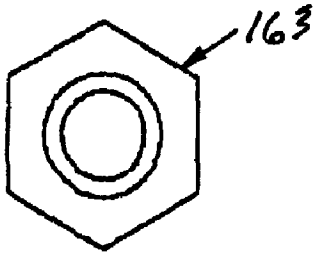
FIG. 27 is an end plan view of the bolt of FIG. 26.
Figure 28:
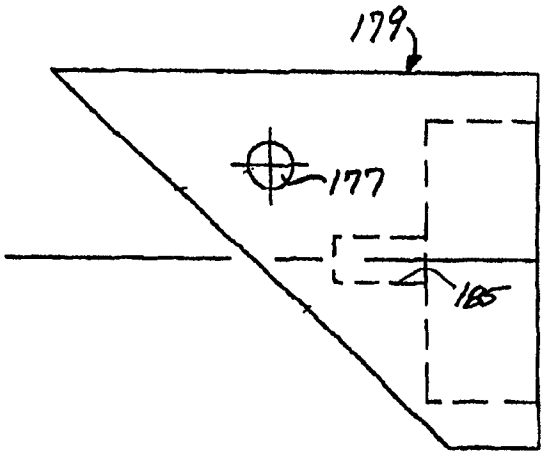
FIG. 28 is a side plan view of a dirt protector and locking cap for the alternative connection of FIG. 20.
Figure 29:
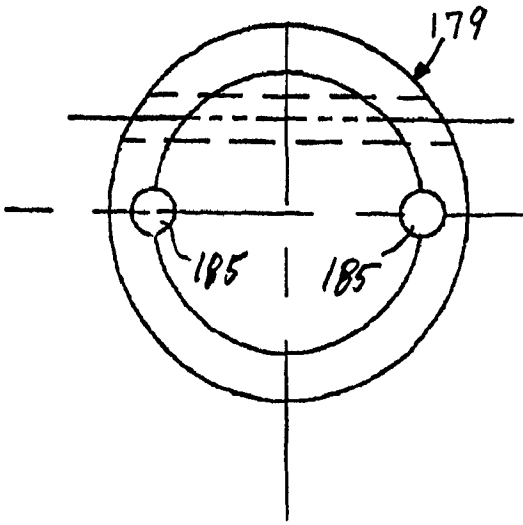
FIG. 29 is an end view of the cap of FIG. 28, as viewed from the inner end of the cap.

Referring to FIGS. 17-19, each member 12 has side walls 22 as do the wear plates 3, but the connecting wall 131 is substantially thickened in portions and at its leading end forms a somewhat rearwardly raked attack face 133 which forms an angled edge 135. The edge 135, formed by the intersection of surfaces 137 and 139, has a piercing action, much like the edge 129. Surfaces 137 and 139 are intersected by surface 141 to produce bursting point 149, similar to bursting point 121. The rearward edge of surface 141 is co-terminus with the forward edge of surface 143, the side edges of which form right angles with the outer side surfaces 145 and 147 of the plate 12. Thus, point 143 and edge 135 provide piercing action and the edges 151 and 153 provide shearing. Some shearing may also be provided at the intersection between surfaces 137 and 145 and between 139 and 147, although since this angle is greater than 90.degree. the shearing is not as efficient. The same is true at the intersection between the side surfaces 82 of the tooth 4 and the respective surfaces 127 and 125 thereof.

Referring to FIGS. 20-29, an alternative tooth connection, for a tighter connection, is shown. The teeth 4' and carrier 20' are generally the same as the teeth 4 and carrier 20, except as hereafter described. The attack face of the tooth 4' is essentially the same, but the connection of the tooth to the carrier 20' is different, the tooth 4' being secured to the carrier by a securing pin 161 and a hex headed bolt 163 rather than by the pin 56, etc. The tooth 4' has a key 165 formed on a lower surface 167 of the tooth 4', the lower surface being generally parallel to the bore 169 of the tooth 4' through which the securing pin 161 extends. The key 165 fits into a similarly shaped recess in the confronting surface of the carrier 20' which is parallel to the bore 169 to help secure and locate the tooth 4' relative to the carrier 20'. The securing pin 161 has an inclined attack face end 171 which fits relatively flush with the attack face of the tooth 4'. The securing pin is tapered so as to be reduced in diameter at a point inside the tooth 4' and thereby abuts a similarly tapered surface in the bore 169, to secure the tooth 4' when the bolt 163 is tightened. The hex head of the bolt 163 is received in a counterbore 173 of the carrier 20', which is coaxial with the bore 169 of the tooth 4'. The counterbore 173 is capped off with a cap 179, which acts as a dirt protector and locking device. The cap 179 is secured to the carrier 20' with a spring pin 181, which extends through a bore 177 in the cap 179 and bores in the carrier 20' at each end of the bore in the cap. In addition, two spring pins 183 fit into holes 185 in the recessed inner face of the cap 179 and extend therefrom to be adjacent to opposite flat sides of the hex head of the bolt 163 to thereby prevent the bolt 163 from turning. The spring pins 181 and 183 may be, for example, rolled pins.

The carriers 20, 20' are typically made of steel, and the teeth and wear plates are preferably made of a work hardening steel such as a chrome manganese alloy, or could be a carbide or carbide plated construction.

Figure 30:
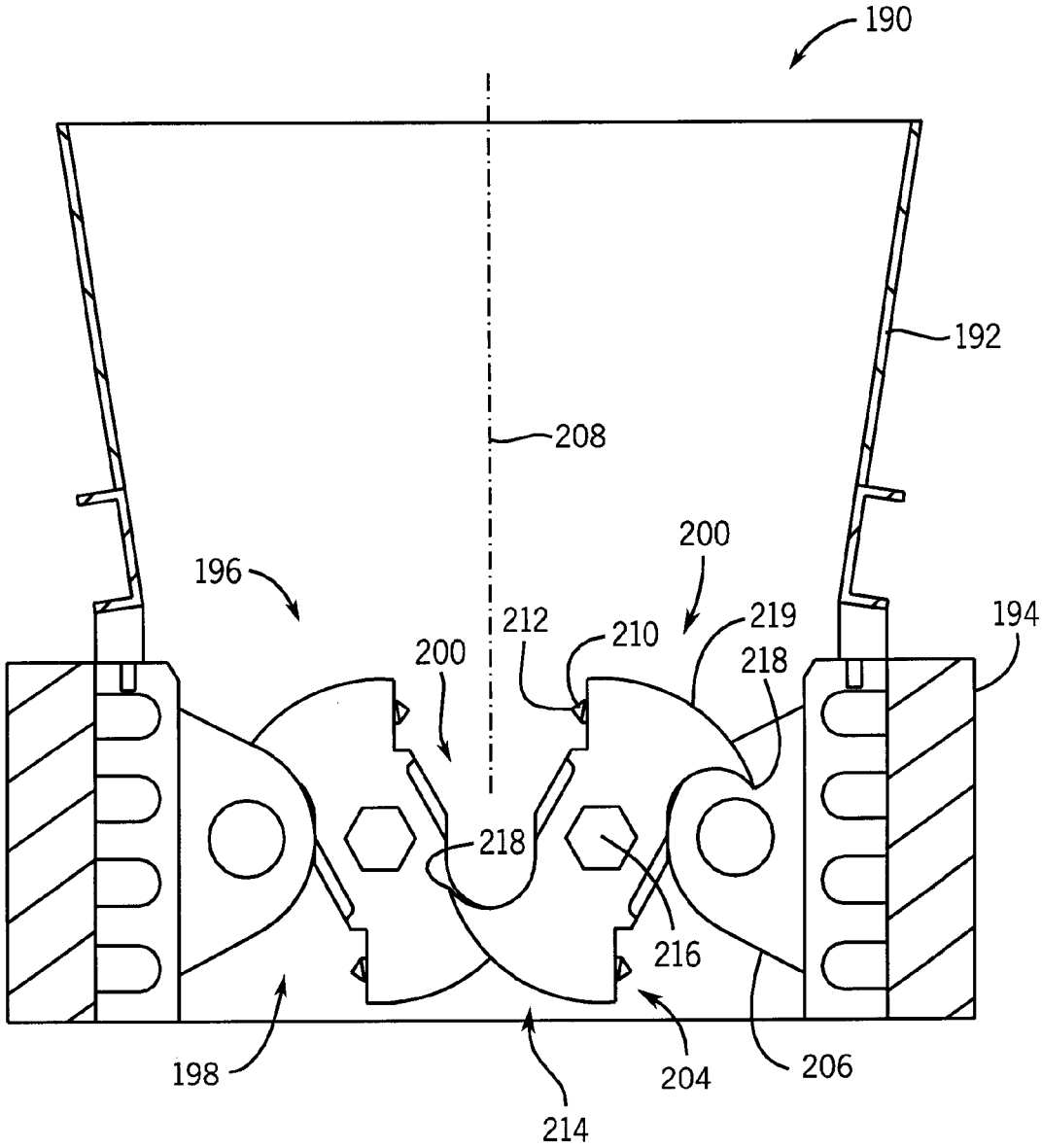
FIG. 30 is a side cross-sectional view of a comminution machine including a reversible blade in accordance with the present invention.
Figure 31:
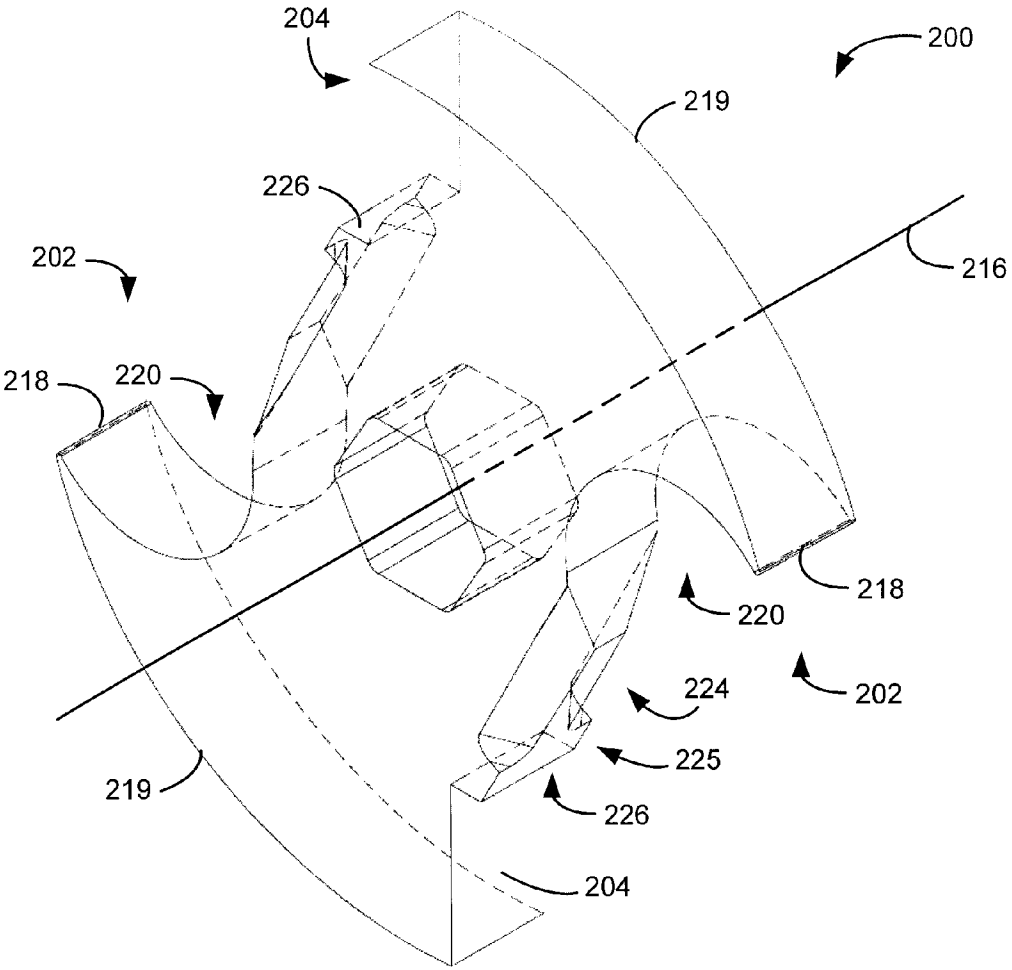
FIG. 31 is a perspective view of a reversible blade of FIG. 30.
Figure 32:
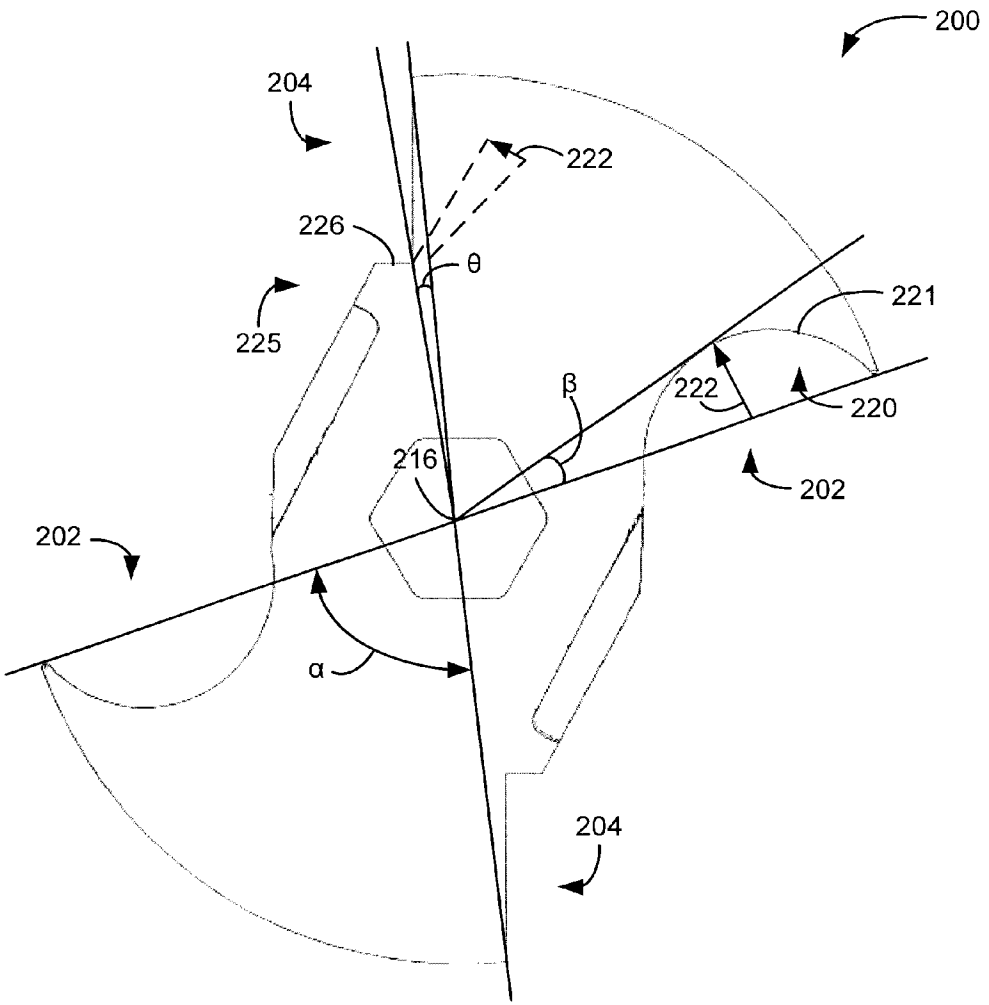
FIG. 32 is a plan view of the reversible blade of FIG. 31.

Referring now to FIGS. 30-32, a comminution machine 190 includes a hopper 192 supported on a frame 194 and configured to receive materials and deliver the materials to a blade system 196 designed to reduce the materials and deliver toward an output 198. The blade system 196 includes blades 200 designed to be reversible. The blades 200 include a reverse attack face 202 designed to be utilized when the blade 200 is rotated in a given direction, with respect to the arrangement shown in FIG. 30, clockwise for the right blade and counterclockwise for the left blade (hereinafter called "outward"). Hence, the new reverse attack face 202 is arranged opposite a traditionally located attack face 204 that is utilized when the blade is rotated in the opposite direction, with respect to the arrangement shown in FIG. 30, counterclockwise for the right blade and clockwise for the left blade (hereinafter called "inward"). Hence, as illustrated in FIG. 30, inward rotation of the blades 200 causes the traditionally located attack face 204 to pull debris from cleaners 206 to be crushed at a center 208 of the blades 200. On the other hand, outward rotation of the blade 200 causes the reverse attack face 202 to pull debris from the center 208 of the blades toward the cleaners 206, which are between the teeth at the outer sides. In this case, the reverse attack face 202 uses the cleaners 206 to aid in crushing the debris.

As will be described in detail below, the traditionally located attack face 204 can include a tooth 210 extending from a central portion of the attack face 204 to a bursting point 212. The tooth 210 is offset from a radial exterior 214 of the blade 200 toward an axis of rotation 216 of the blade 200. While the reverse attack face 202 also includes a bursting point 218, the bursting point 218 is located at the radial exterior 216 of the blade 200. Accordingly, as illustrated in FIG. 32, the opposing attack faces 202, 204 are connected along an arc 219 subtending an angle $\alpha$ along the radial exterior 214 that is at least 30 degrees and less than 110 degrees with respect to the axis of rotation 216. Specifically, it is contemplated that the angle $\alpha$ may be at least 60 degrees and less than 90 degrees. This configuration is specifically designed such that the traditionally located attack face 204 may be advantageously utilized to crush burstable objects and the reverse attack face 202 may be advantageously utilized to reduce objects that are less susceptible to bursting, such as wood, metal, plastic, asphalt, rubber, and soft materials.

Continuing with respect to FIG. 32, a receding surface 220 extends radially inward from the bursting point 218 along an arc 221. As illustrated, the arc 221 forms a hook. In particular, the receding surface 220 of the attack face 202 extends away from the radial outermost point 214 of the blade 200 toward the axis of rotation 216 and, by forming the arc 221, also extends in a direction 222 transverse to the axis of rotation 216 to create a displacement angle $\beta$ that is at least 10 degrees. Accordingly, when the reverse attack face 202 is being utilized, the bursting point 218 and receding surface 220 work in concert to scrape and hook debris. As such, debris is pulled from the radial exterior 214 of the blade 200 toward the axis of rotation 216 by the bursting point 218 to be partially enclosed or trapped by the arced receding surface 220.

As illustrated best in FIGS. 31 and 32, the attack faces 202, 204 are joined by a chamfered region 224 extending from the receding surface 220 at an end opposite the bursting point 218 and terminating at a receding surface 225 of the traditionally located attack face 204. As illustrated in FIG. 32, the attack face 204 extends away from the radial outermost surface 214 toward the axis of rotation 216 and also extends in the same direction 222 transverse to the axis of rotation 216 as the above-described receding surface 220 of the opposing attack face 202 to create a displacement angle $\theta$ of less than 10 degrees.

Figure 33:
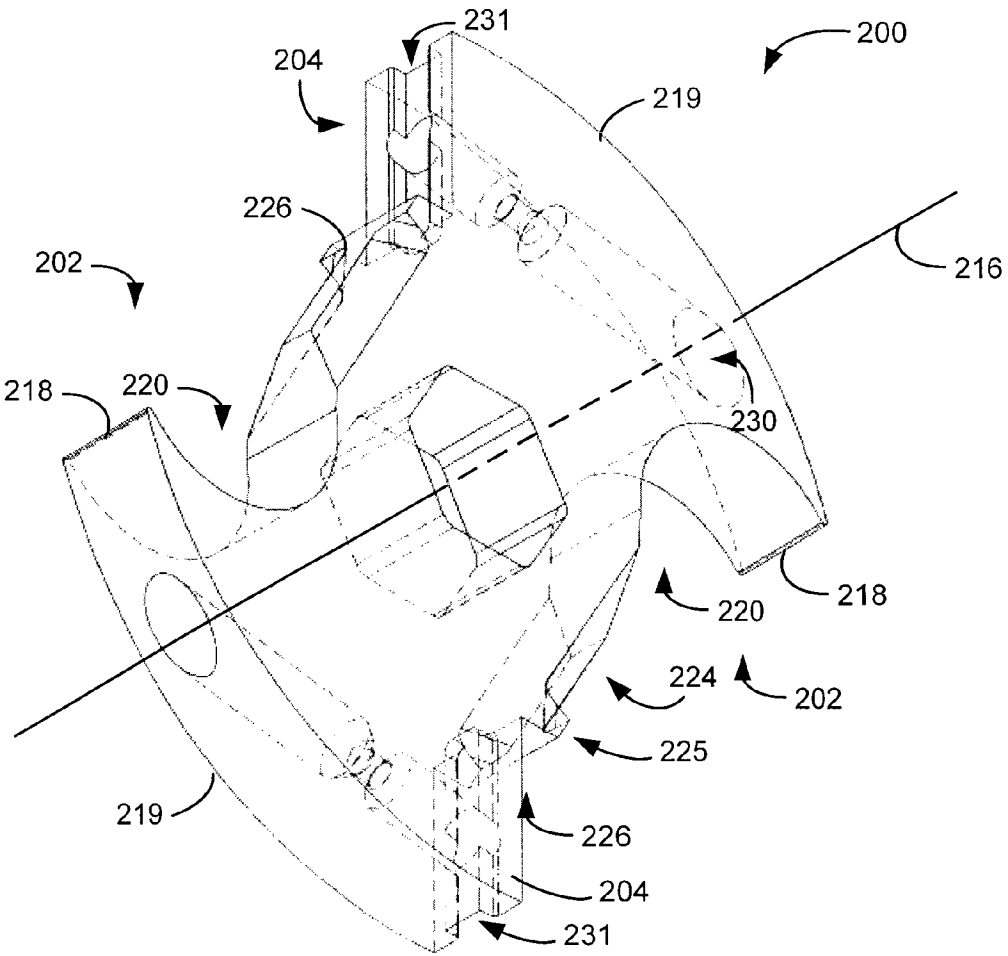
FIG. 33 is a perspective view of the reversible blade of FIGS. 31 and 32 including a optional tooth/plate mounting bore.
Figure 34:
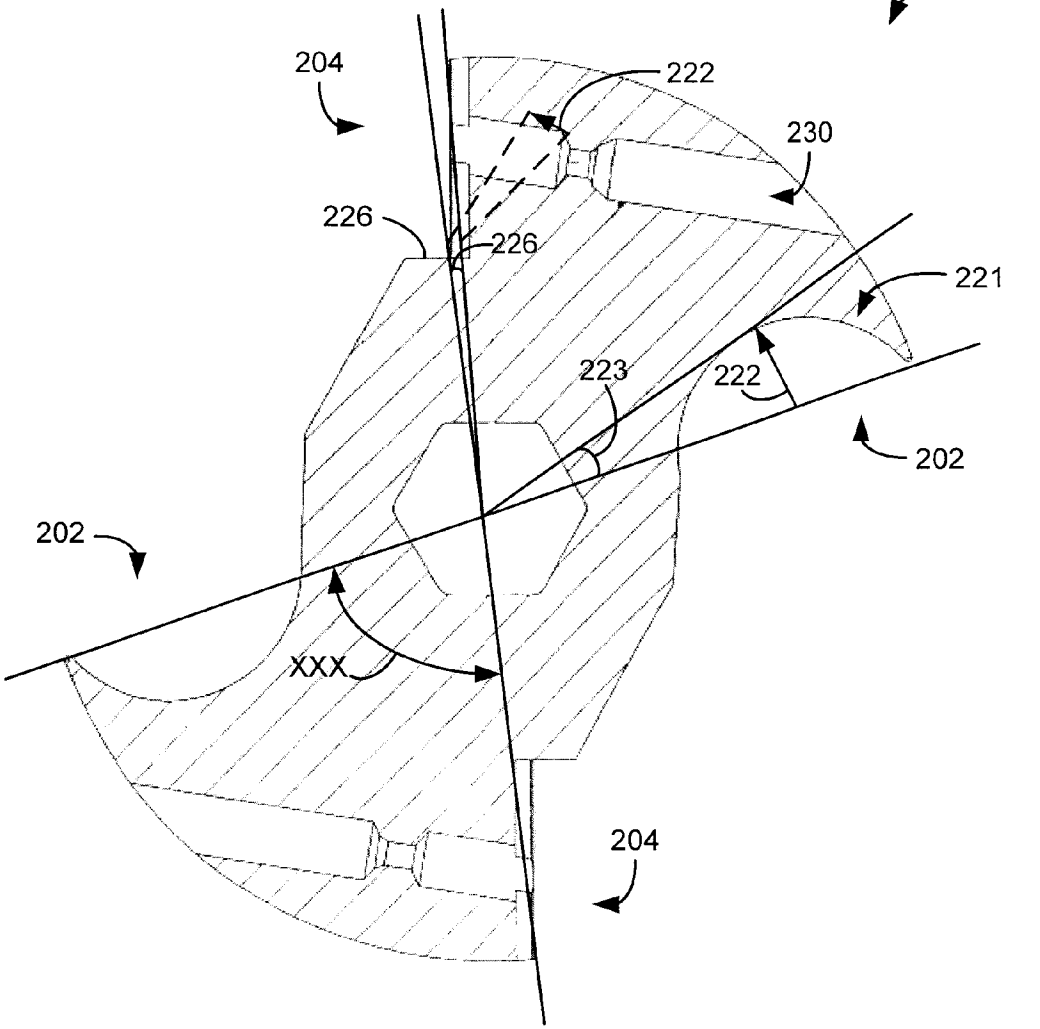
FIG. 34 is a plan view of the reversible blade configuration of FIG. 33.
Figure 35:
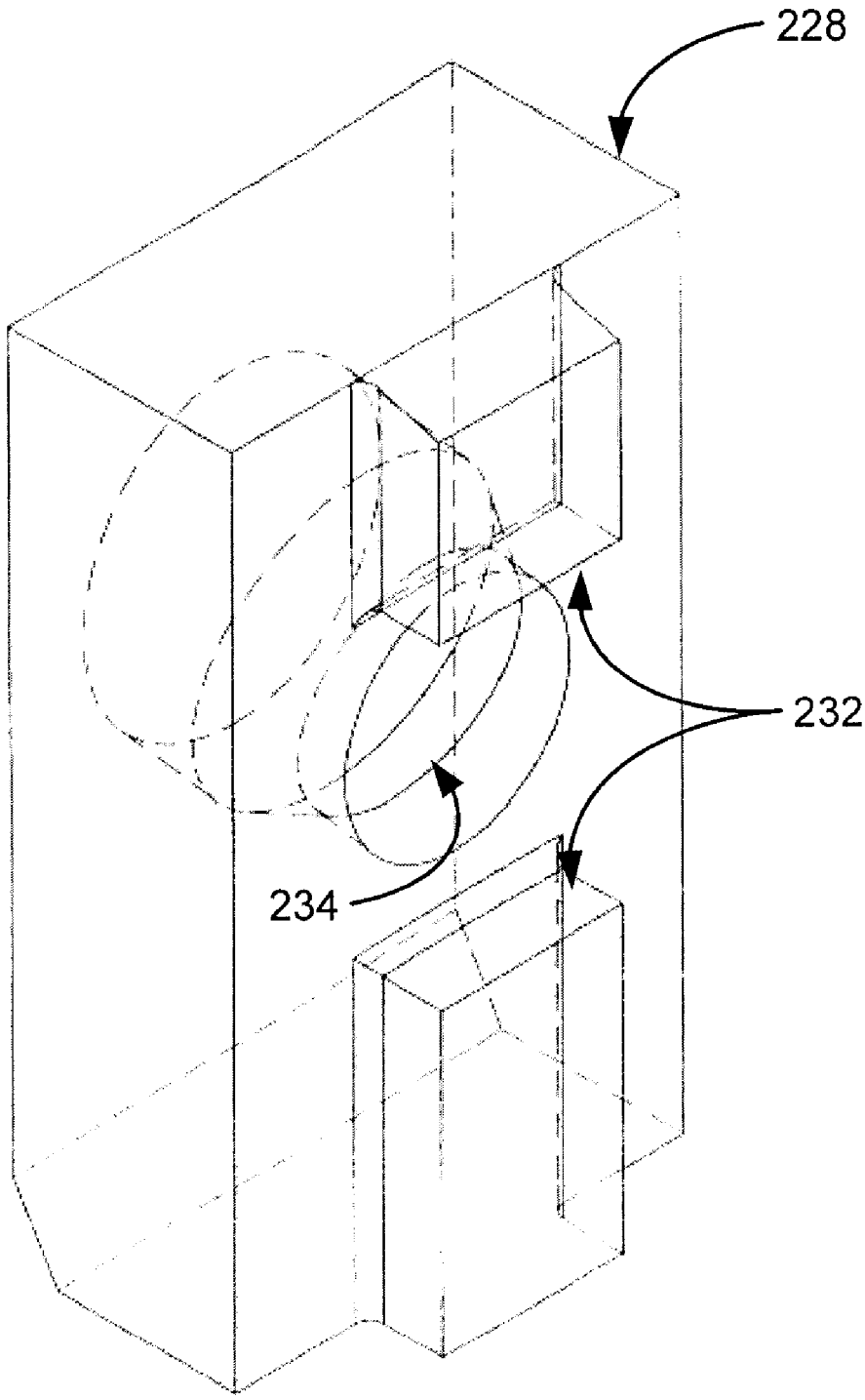
FIG. 35 is a perspective view of a wear plate configured to engage the reversible blade of FIGS. 33 and 34.
Figure 36:
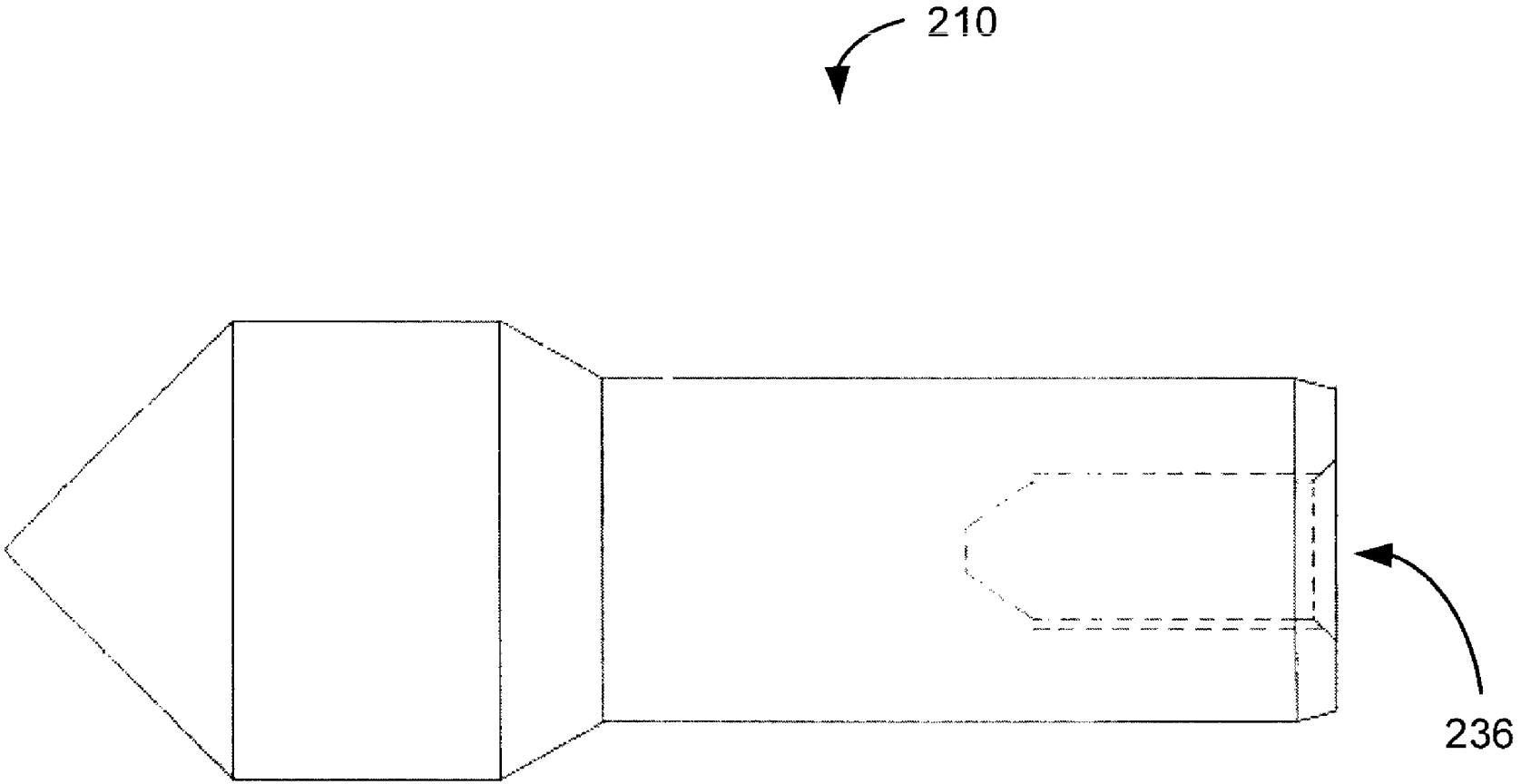
FIG. 36 is a plan view of a tooth configured to couple the wear plate of FIG. 35 to the reversible blade configuration of FIGS. 33 and 34.

Referring now to FIGS. 33 and 34, it is contemplated that an offset 226 may be formed on the attack face 204 that extends perpendicularly from the attack face 204. The offset 226 forms one feature of the blade 200 that, when coupled with a variety of other features, advantageously facilitates the use of a removable/replaceable wear plate 228 (FIG. 35) and a removable/replaceable tooth 210 (FIG. 36). In particular, it is contemplated that the blade 200 may include a bore 230 extending proximate to the radial exterior 214 of the blade 200. The bore 230 is configured to receive the tooth 210 illustrated in FIG. 36 to present the bursting point 212 extending from the attack face 204, as illustrated in FIG. 30. As stated above, the blade 200 may also be designed to accommodate a removable/replaceable wear plate 228 along the attack face 204. In this regard, the attack face 204 may include a trough 231 extending from the offset 226 toward the radial exterior 214 of the blade 200 that is designed to mate with a reciprocally-shaped rib 232 formed on the wear plate 228, as illustrated in FIG. 35. As also illustrated in FIG. 35, the wear plate 228 includes a bore 234 designed to align with the bore 230 formed in the blade 200. As such, when the wear plate 228 is engaged with the blade 200 along the attack face 204, the tooth 210 can be extended through the aligned boars 230, 234 where it is secured by extending a threaded shaft (not shown) from an end of the bore 230 opposite the attack face 204 to engage a threaded fitting 236 of the tooth 210. Thus, the tooth 210 serves to secure the wear plate 228 in place against the attack face 204.

Therefore, a reversible blade is provided that is configured to burst burstable materials when rotated in one direction, and shred or crush less or non-burstable materials when rotated in the opposite direction. For example, the blade may advantageously burst concrete when rotated in a first direction (inwardly) and shred or crush organic waste, such as wood or the like, when rotated in the opposite direction (outwardly in the embodiment described above). To achieve this functionality, the blade has two sets of opposing attack faces or different configurations, as described above.

The present invention has been described in terms of the various embodiments, and it should be appreciated that many equivalents, alternatives, variations, and modifications, aside from those expressly stated, are possible and within the scope of the invention. Therefore, the invention should not be limited to a particular described embodiment.

I claim:

1. A blade for a comminution machine comprising:

a first attack face facing in a first direction to perform comminution when the blade is rotated about an axis of rotation in a first rotational direction;

a second attack face facing in a second direction to perform comminution when the blade is rotated about the axis of rotation in a second rotational direction substantially opposite to the first rotational direction, and the second attack face including a second attack face bursting point offset from a radial exterior of the second attack face toward the axis of rotation; and wherein a radial exterior of the first attack face and the radial exterior of the second attack face are connected along an arc subtending at least 30 degrees and less than 110 degrees with respect to the axis of rotation.

2. The blade of claim 1 further comprising:

a third attack face facing in the second direction to perform comminution when the blade is rotated about the axis of rotation in the first rotational direction;

a fourth attack face facing in the first direction to perform comminution when the blade is rotated about the axis of rotation in the second rotational direction substantially opposite to the first rotational direction; and wherein a radial exterior of the third attack face and a radial exterior of the fourth attack face are connected along an arc subtending at least 30 degrees and less than 110 degrees with respect to the axis of rotation.

3. The blade of claim 1 wherein the second attack face bursting point is formed by a tooth extending from the second attack face.

4. The blade of claim 3 wherein the tooth is removable from the blade.

5. The blade of claim 1 wherein the arc subtends at least 60 degrees and less than 90 degrees.

6. The blade of claim 1 further comprising a removable wear plate extending along at least a portion of the second attack face.

7. The blade of claim 6 further comprising a tooth configured to extend through the wear plate to secure the wear plate to the second attack face.

8. The blade of claim 7 further comprising a bore extending through the blade and configured to receive the tooth therein to secure the tooth and wear plate to the blade.

9. The blade of claim 1 further comprising a first attack face bursting point extending from the first attack face at the radial exterior of the first attack face.

10. The blade of claim 9 further comprising a receding surface extending radially inward from the first attack face bursting point in an arc subtending to create a displacement angle of at least 10 degrees with respect to the axis of rotation.

11. The blade of claim 10 further comprising a chamfered surface extending from the receding surface at an end opposite the first attack face bursting point.

12. The blade of claim 10 wherein when the blade is rotated in the first rotational direction about the axis of rotation, the first attack face bursting point extending from the first attack face pushes encountered materials toward the receding surface to be at least partially enclosed therein by the arc.

13. A blade for a comminution machine comprising:

a first attack face facing in a first direction to perform comminution when the blade is rotated about an axis of rotation in a first rotational direction and extending from a radial outermost point of the blade;

a second attack face facing in a second direction to perform comminution when the blade is rotated about the axis of rotation in a second rotational direction substantially opposite to the first rotational direction and extending from the radial outermost point of the blade;

wherein the first attack face recedes away from the radial outermost point of the blade toward the axis of rotation and toward a first direction transverse to the axis of rotation to create a displacement angle of at least 10 degrees; and wherein the second attack face advances from the radial outermost point of the blade toward the axis of rotation and toward the first direction transverse to the axis of rotation to create a displacement angle of less than 10 degrees.

14. The blade of claim 13 wherein a radial exterior of the first attack face and a radial exterior of the second attack face are connected along an arc subtending at least 30 degrees and less than 110 degrees with respect to the axis of rotation.

15. The blade of claim 13 wherein the second attack face includes a second attack face bursting point configured to engage materials contacting the blade when the blade is rotated about the axis of rotation in the second rotational direction.

16. The blade of claim 15 wherein the second attack face bursting point is formed by a removable tooth extending through a bore extending through the second attack face and a removable wear plate arranged on at least a portion of the second attack face.

17. The blade of claim 13 further comprising a first attack face bursting point extending from the first attack face at a radial exterior of the blade and a receding surface extending radially inward from the first attack face bursting point in an arc subtending at least 10 degrees with respect to the axis of rotation.

18. The blade of claim 17 further comprising a chamfered surface extending from the receding surface at an end opposite the first attack face bursting point.

19. The blade of claim 17 wherein when the blade is rotated in the first rotational direction about the axis of rotation, the first attack face bursting point pushes encountered materials toward the receding surface to be at least partially enclosed therein by the arc.

20. The blade of claim 13 further comprising:

a third attack face facing in the second direction to perform comminution when the blade is rotated about the axis of rotation in the first rotational direction;

a fourth attack face facing in the first direction to perform comminution when the blade is rotated about the axis of rotation in the second rotational direction; and wherein a radial exterior of the third attack face and a radial exterior of the fourth attack face are connected along an arc subtending at least 30 degrees and less than 110 degrees with respect to the axis of rotation.

21. A blade for a comminution machine comprising:

a first attack face facing in a first direction to perform comminution when the blade is rotated about an axis of rotation in a first rotational direction and extending from a radial outermost point of the blade;

a second attack face facing in a second direction to perform comminution when the blade is rotated about the axis of rotation in a second rotational direction substantially opposite to the first rotational direction and extending from the radial outermost point of the blade;

a second attack face bursting point extending from the second attack face and offset from a radial exterior of the second attack face toward the axis of rotation; and wherein the first attack face includes a hook.

22. The blade of claim 21 wherein the first attack face includes a receding surface extending radially inward from a radial exterior of the blade along an arc to form the hook.

* * * * *